US007182612B1

(12) United States Patent
Immethun

(10) Patent No.: US 7,182,612 B1
(45) Date of Patent: Feb. 27, 2007

(54) ELECTRICAL CONNECTOR ASSEMBLIES

(75) Inventor: Greg J. Immethun, Lee's Summit, MO (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/262,926

(22) Filed: Nov. 1, 2005

(51) Int. Cl.
*H01R 13/648* (2006.01)

(52) U.S. Cl. ..... 439/108; 439/927

(58) Field of Classification Search ..... 439/939, 439/927, 607, 609, 610, 108, 95, 364, 368, 439/248; 174/35 GL, 50.52, 50.53, 50.5
See application file for complete search history.

(56) References Cited

U.S. PATENT DOCUMENTS 4,975,085 A * 12/1990 Cartesse et al. ..... 439/609
5,911,595 A * 6/1999 Orr et al. ..... 439/471
6,280,257 B1 8/2001 North et al.
6,663,431 B1 12/2003 Brehm et al.
2002/0042228 A1* 4/2002 Yoshioka ..... 439/610
2003/0032324 A1 2/2003 Lazaro, Jr.
2003/0092307 A1 5/2003 Hirschberg et al.

* cited by examiner

*Primary Examiner*—Ross Gushi
(74) *Attorney, Agent, or Firm*—Ingrassia Fisher & Lorenz

(57) ABSTRACT

An electrical connector assembly comprising a first housing configured to receive a first electrical connector and a second housing configured to receive a second electrical connector. The first electrical connector may be configured to be placed in a mated position with the second electrical connector so as to provide an electrical signal pathway therebetween when in the mated position. The electrical connector assembly may also comprise a shield comprising a plurality of biased members configured to provide electrical connectivity between the first housing and the second housing when the first electrical connector is in the mated position with the second electrical connector.

14 Claims, 12 Drawing Sheets

ELECTRICAL CONNECTOR ASSEMBLIES

TECHNICAL FIELD

The present invention is directed to electrical connectors. In particular, the invention relates to electrical connector assemblies for use in providing a connection between a connector backshell assembly and a connector assembly located on an electronic component to which an electrical signal (e.g., power and/or data) is being supplied.

BACKGROUND

Conventional electrical connector assemblies, such as those providing a connection between electrical wire (e.g., cable) and electrical connectors on an electronic unit or other similar device configured to receive electrical signals from an electrical wire, often include an electrical connector assembly disposed on the electronic unit and an electrical connector assembly attached to one or more wires (which may form one or more cables, for example). The cable electrical connector assembly may include a housing, often referred to as a backshell, that has an opening at one end for receiving wire that terminates in one or more electrical connectors, comprising male or female contact parts (e.g., pins, prongs, receptacles, etc.) The housing also may have an opening at an opposite end for mating with the electrical connector assembly of the electronic unit. The backshell may be further configured to protect the wires and electrical connector of the cable connector assembly and also to protect the mating connection of the cable connector assembly to the electronic unit connector assembly. The electronic unit electrical connector assembly may have one or more electrical connectors comprising male or female contact parts configured to mate with the electrical contact parts of the cable electrical connector assembly. Further, the electronic unit connector assembly also may have a housing that surrounds and protects the electrical connectors of the electronic unit connector assembly and mates with the cable connector backshell.

Aside from a mechanical connection, it may be desirable to provide electrical connectivity between the cable backshell and the connector assembly on the electronic unit in order to hinder stray EMI (electromagnetic interference) or RFI (radio frequency interference) from flowing into the unit's electronics where damage may occur. In some conventional devices, relatively complex electrical shields comprising a plurality of parts may be used to provide electrical connectivity between the backshell and the unit connector housing. In other conventional devices, electrical shields having gasket-like configurations have been used to provide electrical connectivity between the backshell and the housing of the electronic unit connector assembly. Some of these conventional shields have substantially planar configurations and are provided on a surface of the unit housing that faces the cable connector assembly so as to surround the electrical connector of the unit connector assembly. The backshell often may have a lateral wall, a free end of which comes into contact with the electrical shield when the cable connector and unit connector are engaged in a fully mated condition.

In some conventional connector assemblies, fasteners, such as screws for example, are used to provide a sufficient mating force between the backshell and the unit connector assembly. These fasteners provide a force in addition to the mating connection between the cable connector assembly and the unit connector assembly (e.g., between the pins and the receptacles and/or between the backshell and unit housing) to help ensure the mating connection is maintained. Further, in cases where an electrical shield is provided to establish electrical connectivity between the backshell and the unit connector assembly, such fasteners also may help ensure that the backshell maintains contact with the shield, thereby ensuring electrical contact is maintained. In the case of electrical shields in the form of gaskets, plural fasteners often are placed in substantially symmetrical positions relative to the gasket to ensure substantially uniform contact between the backshell and the gasket around the entire gasket.

Fastening mechanisms may be especially important when the electronic unit is subject to relatively rigorous conditions, such as vibrations and other movements that may be prevalent in settings such as aeronautical settings, for example. Moreover, fastening mechanisms may be useful in the case of relatively bulky and/or heavy cables being connected to the electronic unit since the weight of the cables may tend to cause disengagement of the mating connection between the cable connector and the unit connector.

Fasteners conventionally used with electrical connector assemblies are typically manipulated (e.g., removed and/or installed) by operators of the electronic units, which can make the process of connecting the cable connector assembly to the unit connector assembly relatively difficult and/or time-consuming. This may be especially true for conventional fasteners in the form of two screws disposed substantially opposite one another on either side of the cable connector assembly. The operator must manipulate both screws to ensure that contact is made between the backshell and the electrical shield substantially uniformly (e.g., symmetrically) around the shield.

Moreover, such fasteners may result in an electrical connector assembly design that is relatively complex and/or costly.

Thus, it may be desirable to provide an electrical connector assembly that provides electrical connectivity between the cable connector backshell and the unit connector assembly. In maintaining such connectivity, stray EMI and/or RFI may be prevented from flowing to the unit's electronics, thereby protecting the unit electronics from damage.

It may also be desirable to provide an electrical connector assembly that can maintain electrical connectivity between the cable connector backshell and the unit connector assembly without the use of relatively difficult to manipulate fasteners, such as screws, for example, that require relatively difficult manipulation by the operator of the electronic unit during the process of coupling the cable connector assembly to the unit connector assembly. Further, it may be desirable to provide an electrical connector assembly that can maintain electrical connectivity between the cable connector backshell and the unit connector assembly without the need for plural, symmetrically disposed fasteners.

It may be desirable to provide an electrical connector assembly configuration that protects the shield from bending and/or other damage during mating.

It also may be desirable to provide an electrical connector assembly that is relatively simple in design and installation, and relatively inexpensive to manufacture.

Conventional electrical connector assemblies also may include a cable connector assembly wherein wire (which may from one or more cables) exits the back of the backshell. In other words, wire exit the backshell in a direction substantially parallel to the direction in which the cable connector assembly is moved so as to form the mating connection between the cable connector assembly and the unit connector assembly. That is, the cables exit the backshell in a direction substantially perpendicular to the plane defining the interface between the mating connection of the cable connector assembly and the unit connector assembly.

In some settings, such as aeronautical settings, for example, the space into which a cable connector assembly and any wire (e.g., cable) exiting from the backshell must fit for connection to an electronic unit connector assembly is limited. For example, the space between the unit connector assembly and another surface (e.g., a wall or other surface) that runs substantially parallel to the face of the electronic unit that contains the unit connector assembly may be limited. In circumstances where space is limited, the backshell and wire (e.g., cable) extending from the back of the backshell may be too large to fit into the relatively limited space or may be configured such that the portion of the cable exiting the backshell may interfere with a surface adjacent to the unit connector assembly. In other words, conventional cable connector assemblies in which wire exits from a back of the backshell may protrude relatively far from the electronic unit with which the cable connector assembly is configured to mate. In some situations, it may be necessary to bend the wire (e.g., cable) exiting the backshell in order to accommodate the cable connector assembly and any cables extending therefrom. Due to the relative thickness of some types of cables, it may prove difficult to bend the cables and/or to achieve a relatively tight bend (e.g., high radius of curvature). Furthermore, bending a cable exiting the back of the backshell may place a stress on the cable that could cause damage to the cable and/or cause a force on the cable connector tending to pull the cable connector assembly out of proper engagement with the unit connector assembly.

Moreover, in settings with limited space as described above, it may be difficult to remove and/or install a cable connector assembly having one or more cables that exit from the back of the backshell.

Thus, it may be desirable to provide a cable connector assembly configuration that permits the assembly to fit in limited spaces that may be provided when connecting to a unit connector assembly. It also may be desirable to provide a cable connector assembly configuration that occupies relatively less room than in conventional cable connector assemblies during removal and/or connection of the cable connector assembly to the unit connector assembly.

It may further be desirable to provide a cable connector assembly configuration that eliminates the need to bend cables exiting the backshell.

Moreover, it may be desirable to provide an electrical connector assembly that is configured to maintain a mating connection between a cable connector assembly and a unit connector assembly without the need for relatively time-consuming operator installation. For example, it may be desirable to eliminate the need for plural, relatively difficult to manipulate fasteners. It may be desirable instead to provide a relatively easily installed electrical connector assembly.

SUMMARY

Electrical connector assemblies according to exemplary aspects of the present invention may satisfy one or more of the above-mentioned desirable features set forth above. Other features and advantages will become apparent from the detailed description which follows.

According to an exemplary aspect, as embodied and broadly described herein, the invention may include an electrical connector assembly, comprising a first housing configured to receive a first electrical connector and a second housing configured to receive a second electrical connector. The first electrical connector may be configured to be placed in a mated position with the second electrical connector so as to provide an electrical signal pathway therebetween when in the mated position. The electrical connector assembly may comprise a shield comprising a plurality of biased members configured to provide electrical connectivity between the first housing and the second housing when the first electrical connector is in the mated position with the second electrical connector.

In yet another exemplary aspect, the invention may include an electrical connector backshell assembly comprising a housing configured to receive a first electrical connector configured to provide an electrical interface to at least one wire, the first electrical connector being configured for mating with a second electrical connector provided in an electronic unit so as to provide an electrical signal between the first electrical connector and the second electrical connector. The backshell assembly may further comprise at least one opening defined by the housing and configured to receive the at least one wire such that the at least one wire exits the housing in a direction substantially perpendicular to the direction of movement of the housing during mating of the first and second electrical connectors.

According to yet a further exemplary aspect, the invention may include an electrical connector assembly comprising a first housing configured to receive a first electrical connector, the first housing comprising a first lateral wall substantially surrounding the first electrical connector, and a second housing configured to receive a second electrical connector configured to be placed in a mated position with the first electrical connector so as to provide an electrical signal therebetween. The second housing may comprise a second lateral wall substantially surrounding the second electrical connector. The free end of the second lateral wall may be configured to contact a portion of the first housing when the first electrical connector and the second electrical connector are in a mated position so as to provide electrical connectivity between the first housing and the second housing. The first lateral wall may be configured to substantially surround the second lateral wall when the first electrical connector and the second electrical connector are in the mated position.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

The drawings of this application illustrate exemplary embodiments of the invention and together with the description, serve to explain certain principles. In the drawings.

DETAILED DESCRIPTION

Figure 1:
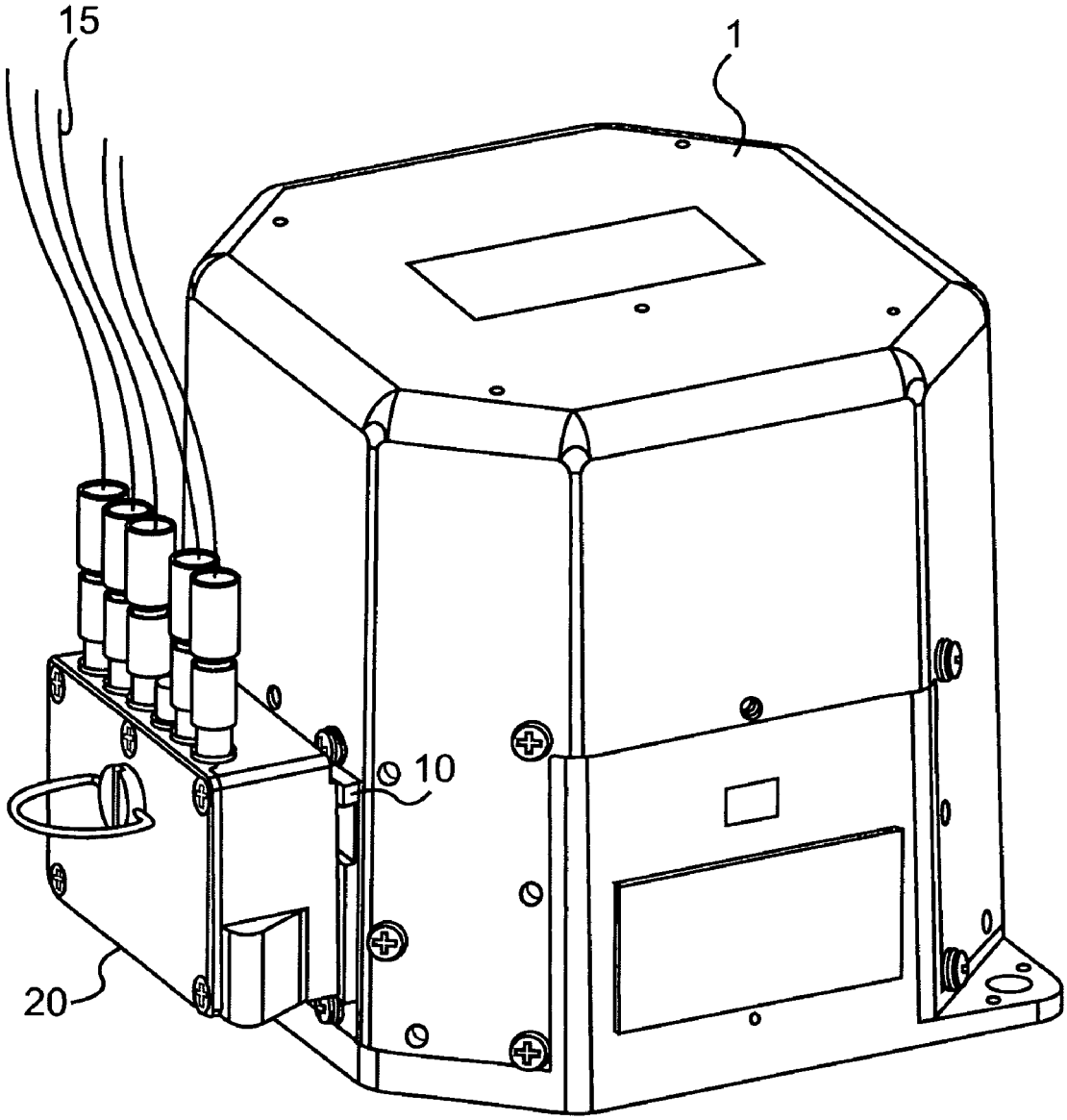
FIG. 1 is a perspective view of a cable connector assembly in mated position with a unit connector assembly of an electronic unit according to an exemplary embodiment of the invention.

An exemplary embodiment of an electrical connector assembly according to aspects of the invention is illustrated in FIG. 1. The electrical connector assembly may include a unit electrical connector assembly 10 provided in an electronic unit 1 and a cable electrical connector assembly 20 which is attached to one or more wires 15, which may be in the form of one or more cables. The unit connector assembly 10 and the cable connector assembly 20 are configured to mate with each other, as depicted in FIG. 1, so that an electrical signal can flow between the two. To remove the cable electrical connector assembly 20 out of the mated position with the unit electrical connector assembly 10, the cable connector assembly 20 is moved in the direction of the arrow shown in FIG. 1. Further details regarding the exemplary embodiment of the electrical connector assembly illustrated in FIG. 1 and various exemplary aspects thereof will be explained below.

Figures 2, 2A:
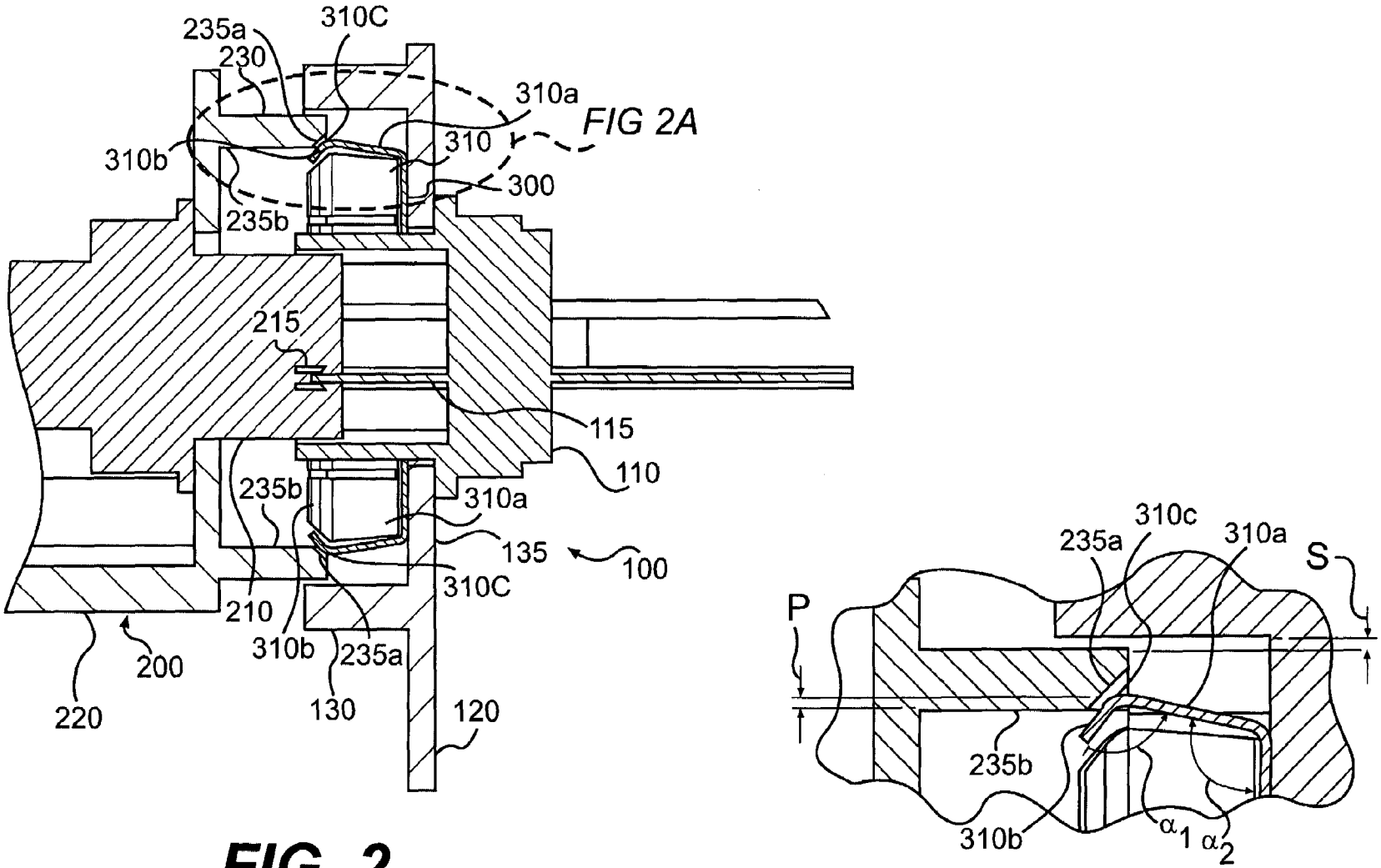
FIG. 2 is a partial cross-sectional view of an exemplary embodiment of a cable connector assembly and unit connector assembly shown in a position during mating of the connector assemblies.
FIG. 2A is a blown-up view of portion 2A of FIG. 2.
Figure 3:
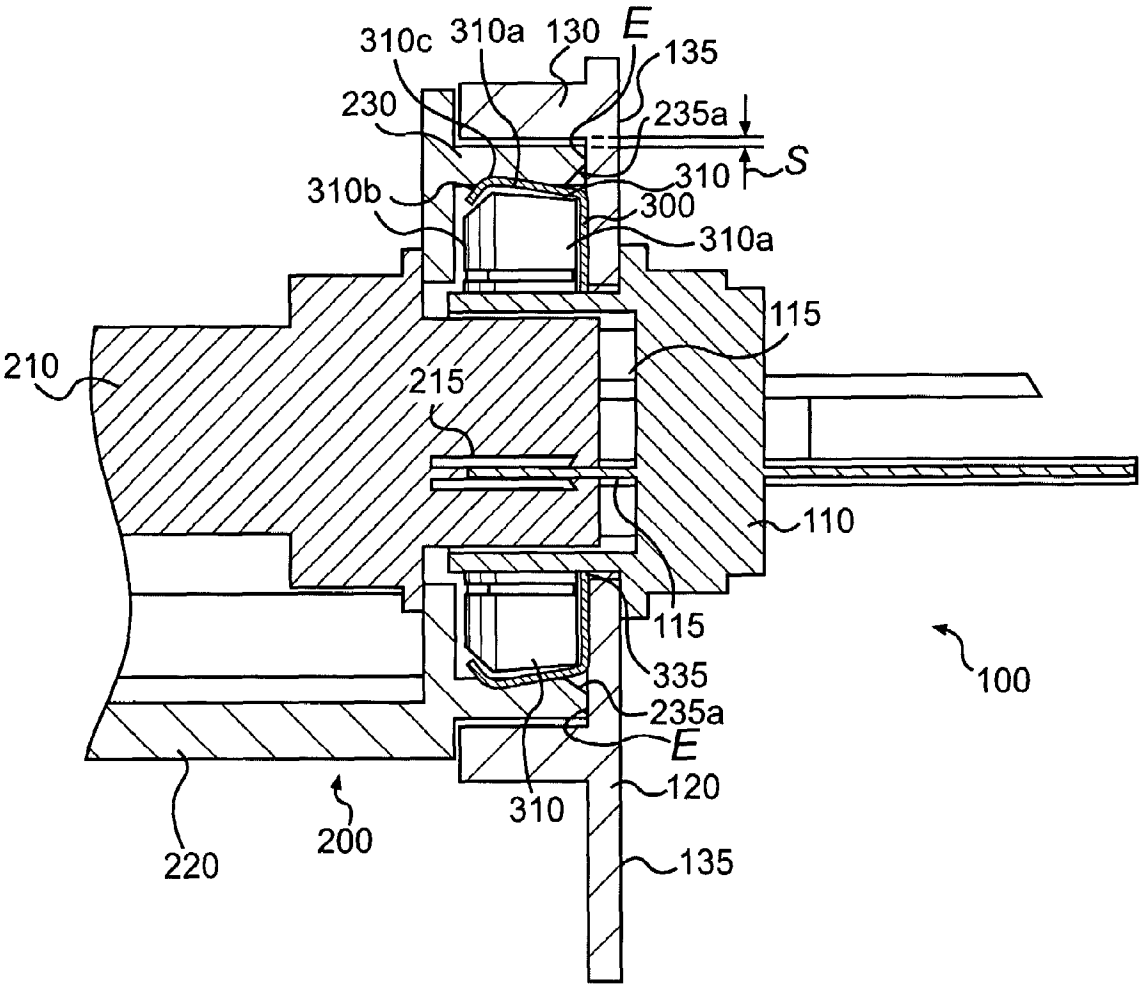
FIG. 3 is a partial cross-sectional view of the cable connector assembly and the unit connector assembly of FIG. 2 in a mated position.

According to various exemplary embodiments, a unit electrical connector assembly may be provided with an electric shield comprising a plurality of fingers. FIGS. 2, 2A, and 3 illustrate various cross-sections of an electrical connector assembly comprising a cable connector assembly 200 and a unit connector assembly 300. With reference to FIGS. 2, 2A, and 3, the cable connector assembly 200 may include a connector 210 which houses and protects at least one wire (not shown) received in the connector 210. The at least one wire may form an electrical interface with one or more electrical contacts, which may be in the form of receptacles 215 configured to receive one or more male electrical contacts 115 of the unit connector assembly 100, as shown in FIG. 3. Alternatively, the at least one wire may form an electrical interface with one or more electrical contacts in the form of pins, prongs, or other similar male contact parts, for example. In this latter embodiment, the male electrical contact parts received in the connector 210 of the cable connector assembly may be configured to be received by mating female electrical contact parts of the unit connector assembly.

The cable connector assembly 200 may further include a housing 220 surrounding the connector 210 and configured to engage with a housing 120 of the unit connector assembly 100, as will be described below. The housing 220 often is referred to as a backshell. As described above, and as illustrated in FIG. 3, the receptacles 215 of the cable connector assembly 200 may be configured to receive male electrical connector parts, such as, for example, pins 115 of the unit connector assembly 100 so as to provide electrical connectivity between the cable connector assembly 200 and unit connector assembly 100. Thus, the cable connector assembly 200 may define an electrical interface for the unit connector assembly 100 to at least one electrical wire. According to an exemplary aspect, the cable connector assembly 200 may define an electrical interface to a plurality of electrical wires (not shown), which may form one or more cables, for example.

As shown in the exemplary embodiment of FIGS. 2 and 3 and described above, the unit electrical connector assembly 100 may include an electrical connector 110 comprising one or more male contact parts, which in the embodiment of FIGS. 2 and 3 are in the form of pins 115, configured to be received by the receptacles 215 of the cable connector assembly 200. In an alternative aspect not shown, the unit connector assembly 100 may be provided with one or more female contact parts, such as, for example, receptacles, and the cable connector assembly may be provided with one or more mating male contact parts, such as, for example, pins, prongs, or other similar contact parts.

The pins 115 may be electrically connected to one or more electronic components housed within the electronic unit to which an electrical signal, such as, for example, a power signal, a data signal for input/output, or other type of electrical signal, is to be supplied. The housing 120 may surround the electrical connector 110 and pins 115 and may be configured to engage with the backshell 220 of the cable connector assembly 200. In the exemplary embodiment of FIG. 3, the cable connector assembly 200 and the unit connector assembly 100 are shown in a mated position.

In the exemplary embodiments of FIGS. 2 and 3, the backshell 220 includes a lateral wall 230 spaced from and surrounding the connector 210. In exemplary aspects, the lateral wall 230 may have a rectangular configuration, a ring-like configuration, or various other configurations, for example. The housing 120 of the unit connector assembly 100 also may include a lateral wall 130 spaced from and surrounding the connector 110, and also may have a rectangular, ring-like, or other configuration, for example. Those skilled in the art would understand that the lateral wall of the backshell assembly and the unit housing may have a variety of configurations, such as rectangular, ring-like, square, etc. depending on the type of connector assemblies being used.

According to the exemplary embodiment of FIGS. 2 and 3, the outer peripheral dimensions (e.g., outer diameter) of the backshell lateral wall 230 may be slightly smaller than the inner peripheral dimensions (e.g., inner diameter) of the unit housing lateral wall 130 such that when the unit and cable connector assemblies 100 and 200 are in a mated position (e.g., the pins 115 are received within the receptacles 215), the wall 230 nests inside the wall 130.

The housing 120 and backshell 220 may each comprise a material such as, for example, an aluminum alloy, or a zinc alloy, either of which may have electroless nickel plating, or other conductive material. An electrical shield 300 may provide an electrical connection between the backshell 220 and the housing 120 when the cable connector assembly 200 and the unit connector assembly 100 are in a mated position, as shown in FIG. 3. As discussed above, such electrical connectivity between the backshell 220 and unit connector housing 120 may assist in preventing stray EMI and/or RFI from entering the unit's electronics so as to minimize potential damage to those electronics.

Figure 4:
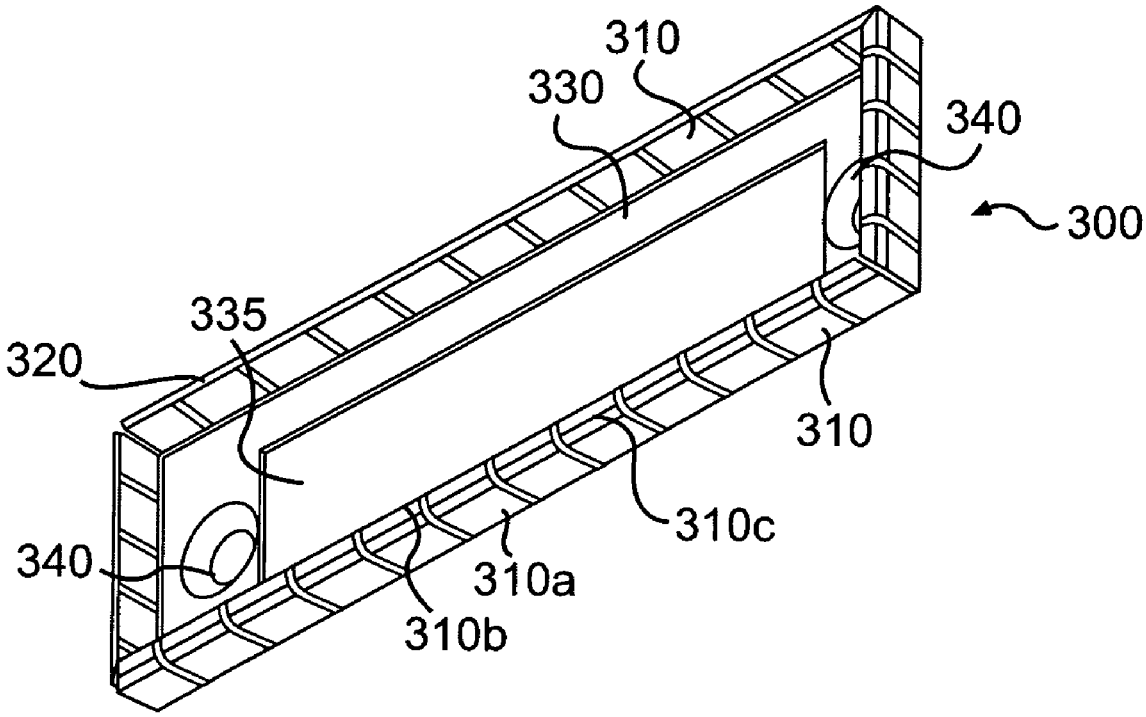
FIG. 4 is a perspective view of the electrical shield of FIGS. 2 and 3.

FIG. 4 illustrates a perspective view of the exemplary embodiment of the electrical shield 300 of FIGS. 2 and 3. The electrical shield 300 comprises a plurality of independently movable fingers 310 positioned around a periphery of the shield 300 so as to define an opening 320. According to an exemplary aspect, the fingers 310 are biased, for example, spring-biased, outwardly away from the longitudinal axis (e.g., center) of the shield 300. The fingers 310 comprise a lower portion 310*a* and an upper portion 310*b*. The lower portion 310*a* and upper portion 310*b* join together at an angle $\alpha_1$ such that the upper portion 310*b* is inclined toward the longitudinal axis of the shield 300, as shown in FIG. 2A. The angle $\alpha_1$ at which the upper portion 310*b* and lower portion 310*a* meet may range from about 95° to about 135° for example, the angle $\alpha_1$ may be about 115 degrees. Where the lower portion 310*a* and upper portion 310*b* of the fingers 310 join, a slight bend (radius) 310*c* is formed that constitutes the outermost surface portions of the fingers 310. In an exemplary embodiment, the bend 310*c* may have a radius of curvature ranging from about 0.01 in. to about 0.15 in., for example, the bend may have a radius of curvature of about 0.03 inches.

The fingers 310 extend from a base portion 330 of the shield 300. The base portion 330 may be substantially planar and the lower portions 310*a* of the fingers 310 may extend from the base portion 330 in a direction substantially perpendicular to the base portion 330. Extending substantially perpendicular should be understood to encompass fingers 310 wherein lower portions 310*a* meet the based portion 330 at an angle slightly less than 90 degrees with the base portion. According to various exemplary embodiments, the fingers 310 may form an angle $\alpha_2$ ranging from about 100° to about 130°, for example, the fingers 310 may form an angle $\alpha_2$ of about 100 degrees.

The base portion 330 may define a relatively large opening 335 and two smaller openings 340, which may be in the form of countersunk openings, for example. As shown in FIGS. 2 and 3, the shield 300 may be configured such that the opening 335 receives a portion of the electrical connector 110, including the pins 115, of the unit connector assembly 100. The openings 340 may be configured to receive securement mechanisms, such as, for example, screws, pins, or other suitable securement mechanisms, configured to secure the shield 300 to a back face 135 of the housing 120. By way of example only, securement mechanisms similar to screws 975 shown in FIG. 14 may be used to secure the shield 300 to the back face 135 of the housing 120 through openings 340. The openings 340 may be positioned such that securement mechanisms placed therethrough could also pass through the connector 110 in addition to the housing 120. For example, securement mechanisms such as screws 975 of FIG. 14 may pass through the openings 340 and may be received in a captive nut in connector 110.

The shield 300 may be made from a variety of materials, including but not limited to, phosphor-bronze, beryllium copper alloy, stainless steel, nickel plated steel, and/or a material that exhibits or may be treated to exhibit spring, elastic, and/or shape memory behavior. In various exemplary embodiments, beryllium copper alloy 25 UNS No. C17200 may be used and may be tempered before being heat treated ¼H or softer. After formation of the shield, the shield may be subjected to a heat treatment for a minimum of about 3 hrs at approximately 625° F. to approximately 700° F. Those having skill in the art would recognize that other treatment processes may be utilized in order to obtain spring-like, elastic behavior so as to minimize permanent deformation. According to various other embodiments, the shield 300 may be made via sheetmetal manufacturing techniques and/or other techniques suitable for making metal components.

As shown in the exemplary embodiment of FIGS. 2, 2A, and 3, the shield 300 may be disposed in conjunction with the unit connector assembly 100 such that the fingers 310 surround the portion of the electrical connector 110 that forms the mating connection with the electrical connector 210 of the cable connector assembly 200. The dimensions of the shield 300 may be such that the fingers 310 are spaced inwardly from the lateral wall 130 of the unit connector assembly 100. In an exemplary aspect, the fingers 310 are spaced inwardly from the lateral wall 130 such that the lateral wall 230 may be inserted between the fingers 310 and lateral wall 130 as further explained below so as to form a guide for properly mating the cable electrical connector assembly 200 and the unit electrical connector assembly 100. By way of example, the outer surface of the lateral wall 230 and the inner surface of the lateral wall 130 may be spaced a distance S from each other when the cable connector assembly 200 and the unit connector assembly 100 are in the mated position. In various exemplary embodiments, the distance S may range from about 0.005 inches to about 0.03 inches, for example, the distance S may be about 0.01 inches. Providing a nominal gap between the lateral wall 130 and the lateral wall 230 may assist in preventing misalignment of the cable and unit electrical connector assemblies when mating the two together.

With reference to FIG. 2A, the fingers 310 may be biased outwardly such that the outermost portion of the fingers (e.g., the bend 310*c*) extends slightly beyond (e.g., outside of) the inner surface 235*b* of the lateral wall 230 just prior to forming a mating connection between the cable connector assembly 200 and the unit connector assembly 100. Thus, the bends 310*c* of the fingers 310 may extend a distance P past the inner surface 235*b* of the lateral wall 230, as shown in FIG. 2A. In this manner, during the mating of the cable connector assembly 200 and the unit connector assembly 100 (e.g., as the pins 115 are advanced into the receptacles 215), the inner surface 235*b* of the lateral wall 230 contacts the bends 310*c* of the fingers 310 to push the fingers 310 inwardly. Once the cable connector assembly 200 and unit connector assembly 100 have been fully mated, as illustrated in FIG. 3, the outward bias of the fingers 310 results in the fingers 310, for example, at bends 310*c*, being relatively tightly pressed against the inner surface 235*b* of the lateral wall 230 such that electrical connectivity is established between the backshell 220 and the housing 120. In various exemplary embodiments, the distance P may range from about 0.005 in. to about 0.03 in., for example, the distance P may be about 0.010 in.

According to an exemplary aspect, the fit between the electrical shield 300 and the lateral wall 230, and the spring bias of the fingers 310, provides a relatively strong force to maintain contact between the shield fingers 310 and the lateral wall 230 and thus maintain the electrical connection between the housing 120 and backshell 220 via the shield 300. Further, the fit between the shield 300 and lateral wall 230 may be such that it provides a sufficient force to maintain the mating connection between the unit connector assembly 100 and cable connector assembly 200 without the need for any additional fasteners, such as screws and/or other similar mechanisms that typically are manipulated by the operator so as to provide a force sufficient to maintain the mating connection.

Nevertheless, especially in settings that experience relatively rigorous motion conditions, it may be desirable to provide such fasteners so as to provide a force to assist in maintaining the mating connection between the electrical connectors 110 and 210. However, due to the relatively tight fit between the shield 300 and the lateral wall 230, the additional force from such fasteners that is needed to maintain that mating connection may be reduced. As such, fasteners that are relatively easy to manipulate may be used. For example, according to yet another exemplary aspect, as will be explained in more detail below with reference to FIGS. 8–14, due to the configuration of the engagement between the lateral wall 230 and fingers 310, it may not be necessary to provide a plurality of fasteners placed in a symmetric relationship around the electrical shield 300. For example, because the surface 235*b* of the lateral wall 230 engages the electrical shield 300 along at least the bends 310*c* of the fingers 310, as opposed to free ends of the lateral wall 230 engaging a planar surface of a conventional electrical shield having a gasket-like configuration, and because the bias of the fingers 310 toward the lateral wall 230 relatively tightly presses the fingers 310 against the lateral wall 230, fasteners symmetrically positioned relative to the electrical shield 300 may not be needed. Rather, in some embodiments it may be sufficient to provide one or more fasteners positioned on one side of the connectors of the cable and unit electrical connector assemblies. Further, fasteners, such as conventional screws, for example, that provide a relatively strong clamping force may not be needed. An exemplary embodiment of a fastener that is suitable for use with electrical connector assemblies comprising electrical shields according to aspects of the invention is discussed in more detail below with reference to FIGS. 11, 13, and 14.

As discussed above, the spacing between the lateral wall 130 and the fingers 310 may be such that the lateral wall 230 of the backshell 220 can just fit into the space when the unit connector assembly 100 and the cable connector assembly 200 are in a mated position. Aside from the electrical connectivity and contact between the lateral wall 230 and fingers 310 discussed above, the spacing provides a relatively tight fit between lateral walls 130 and 230, which further protects the electrical connection between the cable connector assembly 200 and the unit connector assembly 100. Moreover, the relatively tight fit helps to guide the assemblies 100 and 200 into appropriate position for mating of the connector portions 115 and 215, as shown in FIG. 2A. The relatively tight fit also assists in maintaining a substantially parallel plane between the assemblies 100 and 200 when in a mated position, which in turn assists in maintaining the mating connection between the pins 115 and the receptacles 215.

According to another exemplary aspect, as illustrated in FIG. 2, during mating of the cable connector assembly 200 and unit connector assembly 100, the pins 115 may be received in the receptacles 215 before the fingers 310 are guided into the backshell 220. Providing this configuration may minimize potential risk of damage to the fingers 310 which might result from misalignment of the cable connector assembly 200 and the unit connector assembly 100 during mating. Moreover, the inside edge 235*a* of the free end of the lateral wall 230 of the backshell 220 may be beveled, rounded, chamfered, or otherwise blunted, as shown in FIG. 2A, so as to provide a lead in for the shield fingers 310 so as to facilitate engagement of the fingers and minimize damage thereto. During mating of the unit connector assembly 100 and cable connector assembly 200, the upper portion 310*b* of the fingers move relatively smoothly and unobstructed past edge 235*a* until the bend 310*c* engages and ramps up along the inside edge 235*a*. The beveled inside edge 235*a*, therefore, also provides protection against bending or otherwise damaging the fingers 310 during mating.

Although in the description above of the exemplary embodiment of FIGS. 2–4, the electrical shield 300 is described as being connected to the unit electrical connector assembly 100, it should be understood that the electrical shield 300 could be connected to the cable electrical connector assembly instead. Thus, in various exemplary embodiments, it is envisioned that the electric shield 300 may be provided on the backshell of the cable electrical connector assembly. By way of example, it may be envisioned that element 100 in the embodiment of FIGS. 2–4 and its associated components comprise the cable connector assembly and element 200 and its associated components comprise the unit connector assembly. In that exemplary configuration, connector 110 may be in electrical connection with one or more wires and connector 210 may be in electrical connection with an electrical component of an electronic unit.

Figure 5:
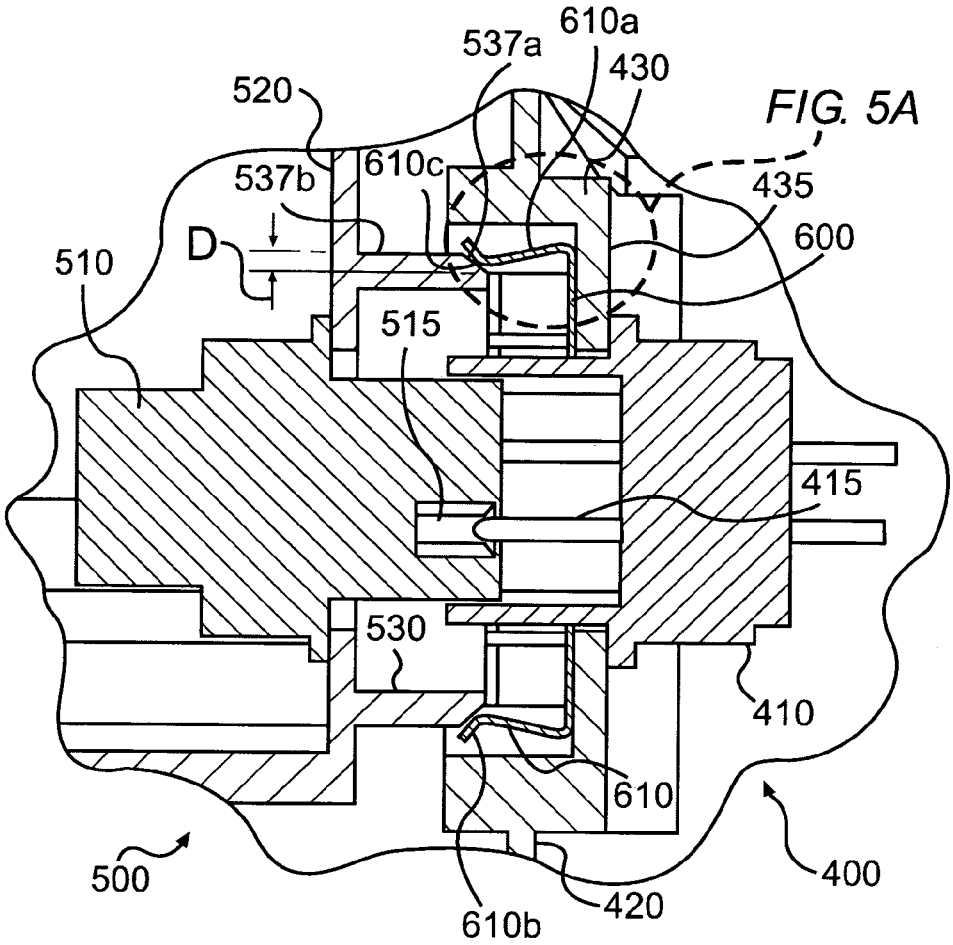
FIG. 5 is a partial cross-sectional view of another exemplary embodiment of a unit connector assembly and cable connector assembly during mating of the connector assemblies.
Figure 6:
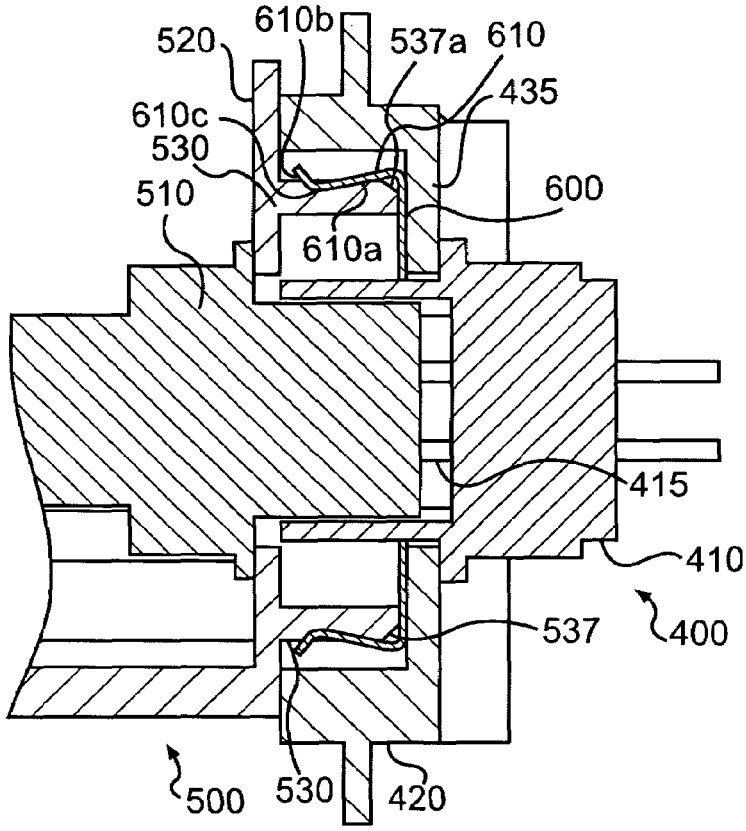
FIG. 6 is a partial cross-sectional view of the unit connector assembly and cable connector assembly of FIG. 5 in a mated position.
Figure 7:
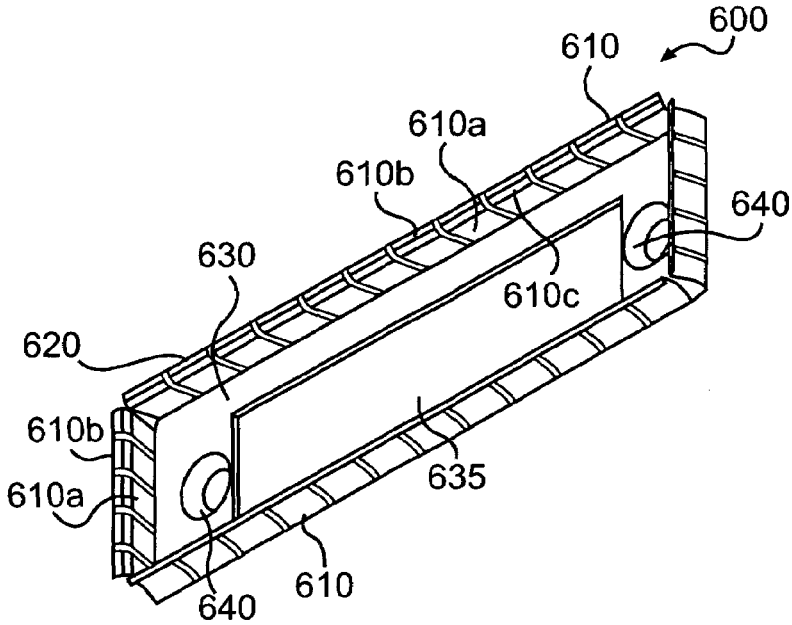
FIG. 7 is a perspective view of the electrical shield of FIG. 5.

Referring now to FIGS. 5–7, another exemplary embodiment of an electrical connector assembly is shown. As with the exemplary embodiment of FIGS. 2–3, the exemplary embodiment of the electrical connector assembly illustrated in FIGS. 5–6 includes a cable connector assembly 500 comprising a connector 510 that houses and protects at least one wire (which may form one or more cables) forming an electrical interface with at least one electrical connector contact, for example, in the form of receptacles 515. A backshell 520 surrounds the connector 510. The embodiment of FIGS. 5 and 6 further includes a unit connector assembly 400 comprising a protective housing 420 surrounding and protecting an electrical connector 410, which may comprise one or more electrical contacts in the form of pins 415, for example, configured to be received in the receptacles 515 of the connector 510.

The embodiment of the electrical connector assembly of FIGS. 5–6 differs from that of FIGS. 2–3 in the configuration of the electrical shield 600 and the lateral wall 530 of the backshell 520. As shown in FIG. 7, the electrical shield 600 comprises a plurality of independently movable fingers 610 placed around a periphery of the shield 600 so as to define an opening 620. According to an exemplary aspect, the fingers 610 are biased, for example, spring-biased, inwardly toward the longitudinal axis (e.g., center) of the shield 600. The fingers 610 comprise a lower portion 610*a* and an upper portion 610*b*. The upper portion 610*b* and lower portion 610*a* join together at an angle $\alpha_3$, shown in FIG. 5A, such that the upper portion 610*b* is inclined away from the longitudinal axis of the shield 600. In other words, the upper portion 610*b* flares slightly outwardly. The angle, $\alpha_3$,, at which the upper portion 610*b* and the lower portion 610*a* meet may range from about 95° to about 135°, for example, $\alpha_3$ may be about 115°. Where the lower portion 610*a* and upper portion 610*b* of the fingers 610 join, a slight bend (radius) 610*c* is formed that constitutes an innermost surface portion of each finger 610. The bend 610*c* may have a radius of curvature ranging from about 0.01 in. to about 0.15 in., for example, about 0.03 in.

The fingers 610 extend from a base portion 630 of the shield 600. The base portion 630 may be substantially planar and the lower portions 610*a* of the fingers 610 may extend from the base portion 630 in direction substantially perpendicular to the base portion 630. Extending in a direction substantially perpendicular to the base portion should be understood to encompass fingers 610 wherein the lower portions 610*a* meet the base portion 630 at an angle $\alpha_4$ slightly less than 90 degrees. For example, $\alpha_4$ may range from about 500 to about 80°, for example, $\alpha_4$ may be about 80 degrees.

Similar to base portion 330 of FIG. 4, the base portion 630 may define a relatively large opening 635 and two smaller openings 640, which may be countersunk openings, for example. As shown in FIGS. 5–6, the opening 635 may receive a portion of the electrical connector 410, including the pins 415, of the unit connector assembly 400. The openings 640 may be configured to receive securement mechanisms, such as, for example, screws, pins, or other securement mechanisms configured to secure the shield 600 to a back face 435 of the housing 420, in a manner similar to that described with reference to the embodiment of FIGS. 2–3 above. The openings 640 may be positioned such that a securement mechanism placed therethrough could also pass through the connector 410 in addition to the housing 420. For example, securement mechanisms like screws 975 in FIG. 14 may pass through the openings 640 and into a captive nut in the connector 410.

The shield 600 may be made from a variety of materials and techniques, including those materials and techniques discussed above with reference to shield 300 of FIG. 4.

As shown in the exemplary embodiment of FIG. 5, the shield 600 may be disposed in conjunction with the unit connector assembly 400 such that the fingers 610 surround the portion of the electrical connector 410 that forms the mating connection with the connector 510 and electrical connector contacts 515 of the cable connector assembly 500. The outer peripheral dimensions of the shield 600 may be such that the fingers 610 are spaced inwardly from the lateral wall 430 of the unit connector assembly 400 by a nominal distance C. For example, the outer periphery of the shield 600 may be spaced at a distance from the lateral wall 430 ranging from about 0.005 in. to about 0.03 in., for example, the distance C may be about 0.01 in. As will be explained further below, the distance C may be chosen such that the wall 430 prevents the fingers 610 from bending outwardly to a point wherein the fingers 610 may permanently deform.

Figure 5A:
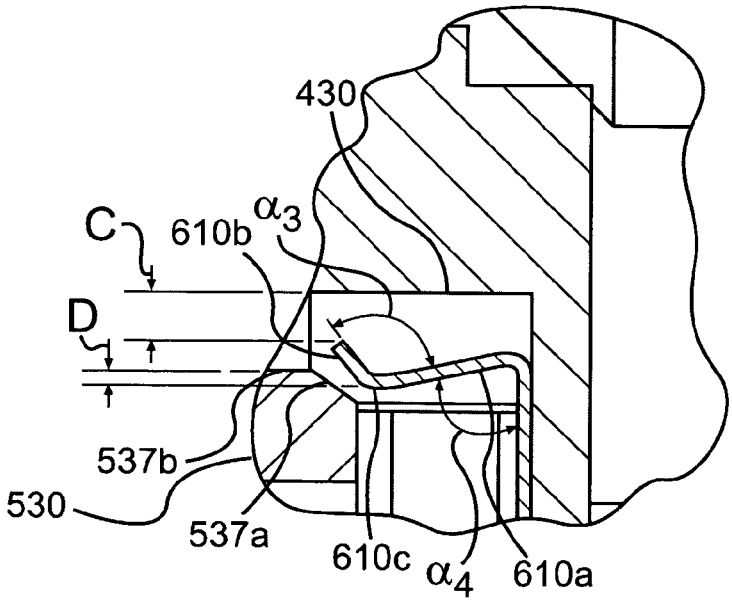
FIG. 5A is a blown-up view of portion 5A of FIG. 5.

As explained above, the fingers 610 may be biased inwardly such that the innermost portions of the fingers (e.g., the bend 610*c*) extend slightly inwardly of the outer surface 537*b* of the lateral wall 530 just prior to forming a mating connection between the cable connector assembly 500 with the unit connector assembly 400. Thus, the innermost portions of the fingers 610 may extend a distance D inwardly of the inner surface of the lateral wall 530, as shown in FIGS. 5 and 5A. In various exemplary embodiments, the distance D may range from about 0.005 in. to about 0.030 in. for example, the distance D may be about 0.010 in.

In this manner, during the mating of the cable connector assembly 500 and the unit connector assembly 400 (e.g., as the pins 415 are advanced into the receptacles 515), the outer surface 537*b* of the lateral wall 530 contacts the bends 610*c* of the fingers 610 and pushes the fingers 610 outwardly. Once the cable connector assembly 500 and unit connector assembly 400 have been fully mated, as illustrated in FIG. 6, the inward bias of the fingers 610 results in the fingers 610 being relatively tightly pressed against the outer surface of the lateral wall 530 at bends 610*c* such that electrical connectivity is established and maintained between the backshell 520 and the housing 420.

According to an exemplary aspect, the spring-bias of the fingers 610 and the spacing between the fingers 610 and the lateral wall 530 may be such that a sufficient force is provided to maintain the mating connection between the electrical connectors 410 and 510 of unit connector assembly 400 and cable connector assembly 500 without the need for fasteners, such as screws and/or other similar mechanisms that typically are manipulated by the operator so as to provide a clamping force sufficient to maintain the mating connection. As explained above with reference to the embodiment of FIGS. 2 and 3, however, in settings experiencing relatively rigorous motion conditions, such fasteners may be needed to assist in maintaining the mating connection between the electrical connectors, and may be in the form of one or more fasteners positioned to one side of the connectors of the electrical connector assembly; the fasteners need not be either plural or symmetrically spaced or configured so as to be relatively difficult to manipulate. According to an exemplary aspect, a fastener such as that discussed below with reference to FIGS. 8–14 may be used.

Moreover, as with the exemplary embodiment of FIGS. 2–4 various features of the embodiment of FIGS. 5–7 serve to protect the fingers 610 from bending, deformation, and/or other damage. For example, when mating the cable connector assembly 500 and the unit connector assembly 400, the male contacts 415 and the female contacts 515 begin to engage with each other prior to lateral wall 530 and the fingers 610 engaging. In this way, appropriate alignment of the connector assemblies 400 and 500, and thus between the lateral wall 530 and fingers 610, can occur so as to avoid damaging the fingers 610 by potential misalignment and improper contact between the fingers 610 and wall 530.

In another exemplary aspect, the outside edge 537*a* of the free end of the lateral wall 530 of the backshell 520 may be beveled, rounded, chamfered, or otherwise blunted so as to provide a lead in for the insertion of the lateral wall 530 within the fingers 610, which may facilitate mating and minimize damage of the fingers 610 during mating. Thus, at the initiation of mating between the cable connector assembly 500 and the unit connector assembly 400, the electrical contacts 415 and 515 can engage and the fingers 610 can be moved toward lateral wall 530 but will not come into contact with the lateral wall 530 initially due to the beveled outside edge 537*a*. This configuration may promote a smooth engagement of the fingers 610 with the lateral wall 530 by allowing the bend 610*c* to ramp up along the edge 537*a*, causing the fingers 610 to bend outward slightly as the lateral wall 530 is inserted further along the length of the fingers 610. Once the cable connector assembly 500 and the unit connector assembly 400 are in a fully mated position, the bend 610*c* of the fingers 610 may be tightly pressed against the outer surface 537*b* of the lateral wall 530 due to the inward bias of the fingers 610.

In addition, the relative proximity between the lateral wall 430 and the fingers 610 also may protect the fingers 610 from damage, such as, for example, permanent deformation due to sufficiently excessive outward bending. That is, the distance C between the lateral wall 430 and the upper portion 610*b* of the fingers 610 may be selected such that the wall 430 stops the fingers 610 from bending outwardly past a position at which permanent deformation of the fingers 610 may occur.

In a manner similar to that described above with reference to the description of FIGS. 2–4, it should be understood that in various exemplary embodiments the electrical shield 600 may be connected to the cable electrical connector assembly instead of the unit electrical connector assembly. Thus, in various exemplary embodiments, it is envisioned that the electric shield 600 may be provided on the backshell of the cable electrical connector assembly. By way of example, it may be envisioned that element 400 in the embodiment of FIGS. 5–7 and its associated components comprise the cable connector assembly and element 500 and its associated components comprise the unit connector assembly. In that exemplary configuration, connector 410 may be in electrical connection with one or more wires and connector 510 may be in electrical connection with an electrical component of an electronic unit.

According to various exemplary embodiments, an electrical connector assembly may be configured such that one or more wires (e.g., which may be in the form of one or more cables, for example) exit the backshell in a direction that is at an angle, for example, substantially perpendicular, to the direction in which the cable connector assembly is moved during mating of the cable connector assembly and the unit connector assembly. That is, the cables may exit the backshell in a direction substantially parallel to the plane defining the interface between the mating connection of the cable connector assembly and the unit connector assembly. Providing such a configuration may facilitate engagement and disengagement of the cable connector assembly and the unit connector assembly. Further, such a configuration may enable the cable connector assembly to occupy less space and thus fit into relatively small spaces that may be available adjacent to an electronic unit connector assembly. Moreover, such a configuration may reduce and/or eliminate the need to bend cables that exit a backshell assembly, thus reducing stress on those cables and/or on the wires.

FIGS. 8–14 illustrate various views of an exemplary embodiment of an electrical connector assembly configured so as to permit wire to exit the backshell in a direction substantially parallel to a plane defining the interface between the mating connection of the cable connector assembly and the unit connector assembly. As shown in the cross-sectional and isometric views of FIGS. 11–14, the electrical connector assembly embodiment also may comprise an electrical shield 1600, for example, having a configuration like that discussed above with reference to FIGS. 5–7. However, it will be apparent to those having ordinary skill in the art that a backshell assembly having a configuration that permits the exiting of wire in a direction substantially parallel to the plane defining an interface of the mating connection may be used in conjunction with a variety of electrical connector assembly configurations and is not limited to use in combination with an electrical connector assembly including an electrical shield as depicted in FIGS. 11–14.

Figure 8:
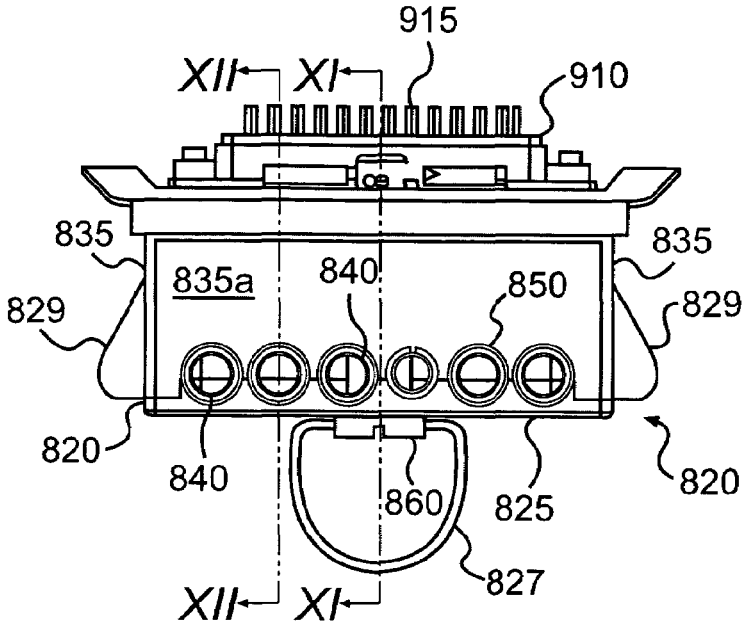
FIG. 8 is a top perspective view of an exemplary embodiment of an electrical connector assembly.
Figure 9:
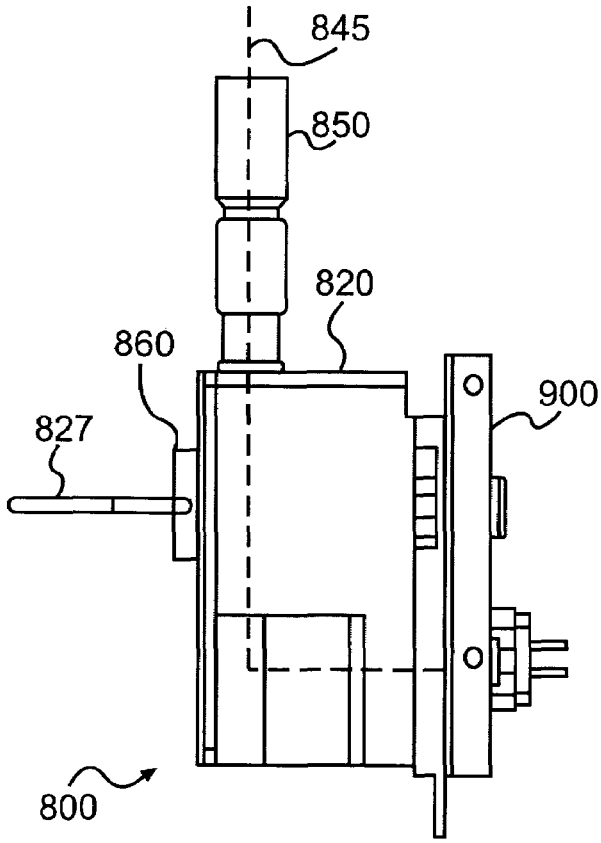
FIG. 9 is side perspective view of the cable electrical connector assembly of FIG. 8 in a mated position with a unit connector assembly.
Figure 10:
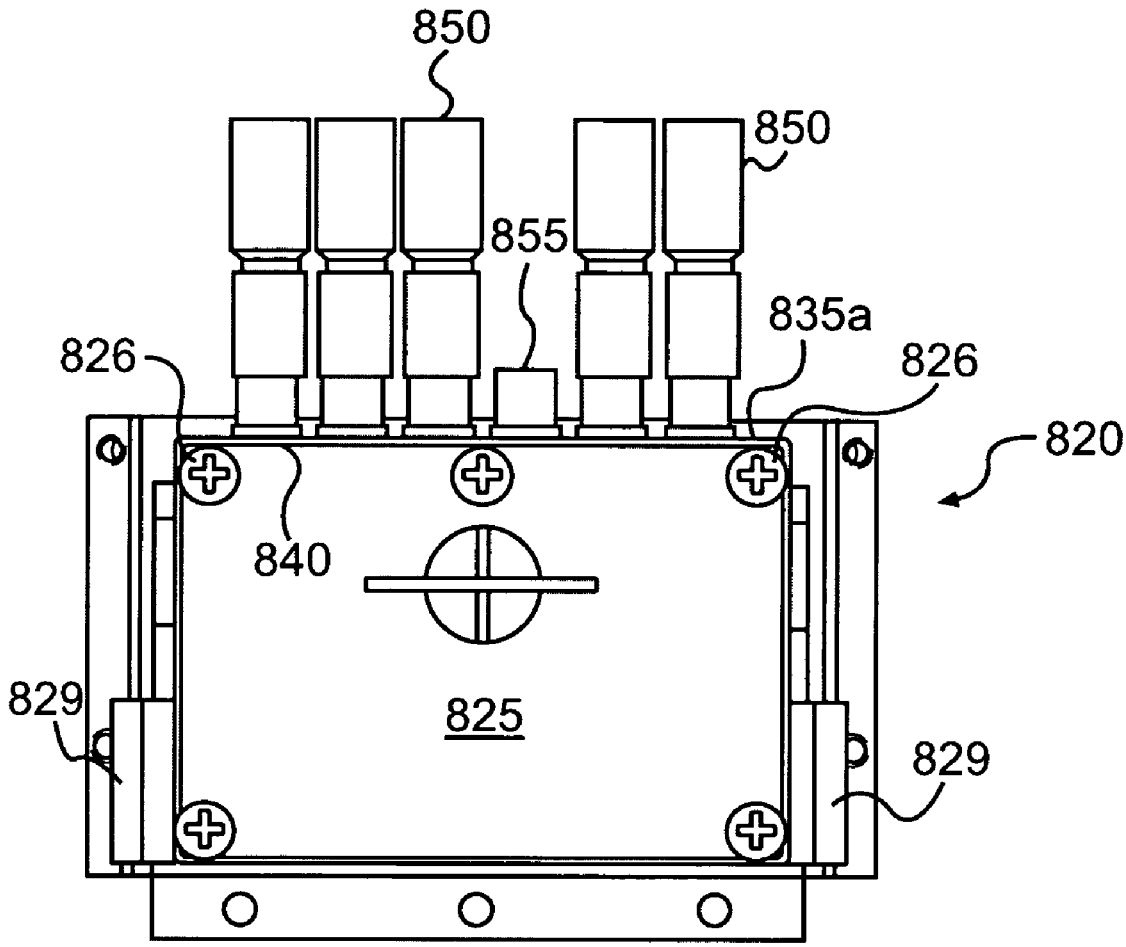
FIG. 10 is a plan view of the cable electrical connector assembly of FIG. 8.

With reference to FIGS. 8–10, a cable connector assembly 800 may comprise a backshell 820 surrounding a connector 810 comprising electrical contacts 815 (not shown in FIGS. 8–10) configured at one end to engage with electrical contacts 915 of an electrical connector 910 associated with an electronic unit, for example. The electrical contacts of the connector 810 are configured at an opposite end to form an electrical interface with one or more wires 845, as shown by the dotted line in FIG. 9. The one or more wires may form one or more cables, for example. In the exemplary embodiment of FIGS. 8–10, the electrical contacts 915 associated with the electronic unit connector assembly 900 are in the form of a plurality of pins, for example, configured to engage with a plurality of receptacles associated with the electrical connector 810 of the cable connector assembly 800. Alternatively, the electrical connector of the cable connector assembly may be in the form of one or more male contacts (e.g., pins, prongs, etc.) configured to be received by a plurality of female contacts (e.g., pins, prongs, etc.) on an electronic unit electrical connector assembly.

As shown in FIG. 8, the backshell 820 may comprise a plurality of lateral surfaces 835 that extend in a direction that is nonparallel to and away from a plane of the electrical interface between the cable connector assembly 800 and the unit connector assembly 900. By way of example, the plurality of lateral surfaces 835 may extend in a substantially perpendicular direction to a plane of the electrical interface between the cable connector assembly 800 and the unit connector assembly 900. The backshell 820 also may comprise a removable backplate 825 configured to be removably secured, for example, via screws 826 to a back of the backshell 820 so as to permit access to the interior of the backshell 820, for example, in order to route wires. Those skilled in the art would understand that the backplate 825 may be removably secured by a variety of securement mechanisms other than via screws, including but not limited to, for example, via snap-fastening, threading, or other securement mechanisms.

According to yet another exemplary aspect and as shown in FIGS. 8 and 9, the backshell 820 also may include protruding portions 829, for example in the form of grip wings. These protruding portions 829 may provide grasping surfaces so as to facilitate a user in grasping the backshell assembly 820 during engaging and disengaging the cable connector assembly with the unit connector assembly.

In contrast to conventional backshell assemblies wherein one or more wires (e.g., in the form of one or more cables, for example) exit the back surface of the backshell assembly 820 (e.g., the surface facing in a direction opposite to the direction the free end of the electrical connector of the cable connector assembly faces), one or more of lateral surfaces 835 of the backshell 820 of FIGS. 8–10 may define one or more openings 840 configured to receive wire (e.g., cable) exiting the backshell 820. As shown in the exemplary embodiment of FIGS. 8–14, for example, a top surface 835*a* may define openings 840 leading to a plurality of tubes 850. Although in the exemplary embodiment shown in FIGS. 8–14, the top lateral surface 835*a* is configured to permit wires to exit the backshell, it should be understood that one or more of the other lateral surfaces 835 could be configured like top surface 835*a*, as discussed below, so as that wires also may exit one or more of those lateral surfaces 835.

According to the exemplary embodiment of FIGS. 8–14, the tubes 850 may comprise a metal tube portion 850*a* with a shrink tube portion 850*b* placed over the metal tube portion 850*a*, such as, for example, tubes made by Tyco Electronics-Raychem Corp. HET-A-04C. The metal tube portion 850*a* may provide the exit path and a place to connect the wire (e.g., to connect a shielding of the wire) so as to ground the wire, while the shrink tube portion 850*b* may provide a seal to prevent moisture and the like from entering the backshell assembly.

According to various exemplary embodiments, the wire may exit the backshell via numerous arrangements, other than tubes, configured so as to route and hold the wire in a desired position, provide strain relief, facilitate grounding of the wire's shielding to the backshell, and/or provide a seal for moisture and/or dirt around the wires. The arrangement used to exit the wire out of the backshell may be chosen based on various factors, such as, for example, the amount of sealing, clamping, strain relief, and/or electrical shielding that is desired. By way of example only, an opening, such as, for example an opening similar to openings 840, may be provided with a clamp mechanism (not shown) formed into the backshell to clamp the exiting wires. In addition, as shown in FIG. 10 for example, if more than one opening 840 is formed in the backshell 820 and the opening is not being used to route a wire from the backshell 820, a plug, such as plug 855, may be used to plug the opening 840 and seal the opening and interior of the backshell 820 from moisture and/or other unwanted material.

Figure 12:
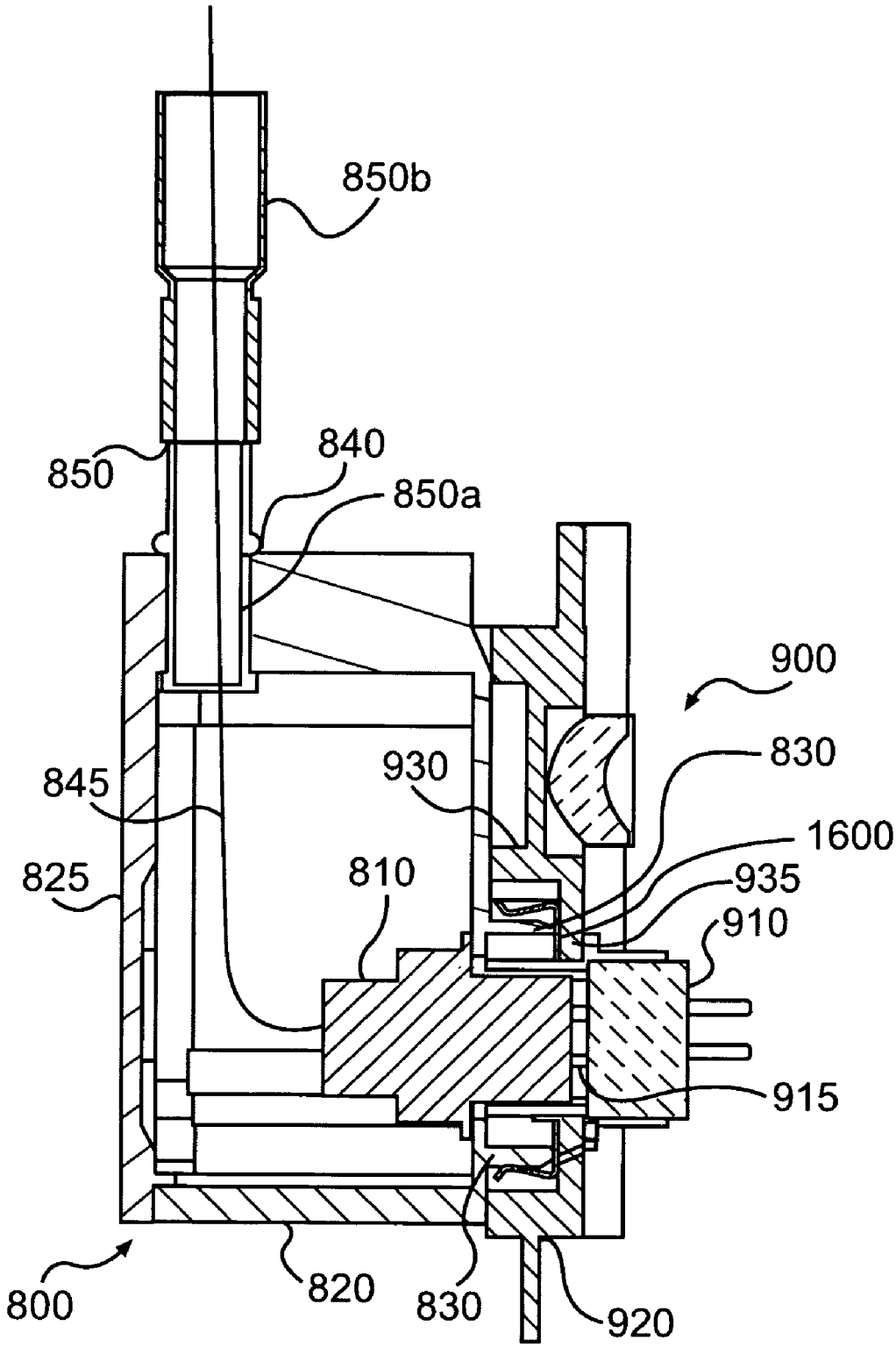
FIG. 12 is a cross-sectional view taken from line XII—XII of the electrical connector assembly of FIG. 9.

One or more wires 845 which may be in the form of one or more cables, for example, may be electrically connected at one end to the contacts 815 within the connector 810 and may bend within the interior of the backshell 820 and exit the backshell 820 through one or more respective openings 840 and tubes 850, for example, as shown by the dotted line in FIG. 9 and in FIG. 12.

According to an exemplary aspect, the wire 845 may bend at an angle of approximately 90 degrees within the interior of the backshell 820 and exit through an opening 840 in the top surface 835*a* and through a tube 850. Moreover, in an exemplary aspect, a plurality of wires may be provided so as to form an electrical interface with the electrical connector of the cable connector assembly and each wire may be bent within the interior of the backshell assembly prior to exiting from a lateral surface of the backshell, as described above with reference to FIG. 9. The plurality of wires may be gathered together so as to form a cable that exits the backshell. Bending individual wires within the backshell prior to gathering them together to form a cable may provide advantages over conventional electrical connector assemblies in which a cable exiting the back of the backshell assembly is bent outside of the backshell assembly in order to fit the cable and cable connector assembly in a relatively small space for mating with the unit connector assembly. Bending a cable outside of the backshell, as opposed to bending the individual wires within the interior of the backshell, may be more difficult due to the bulkiness of the cable and may place stress on the wires in the cable. By bending the individual wires first and then gathering them into a cable, less stress may be placed on the individual wires and bending may be facilitated. Moreover, it may be possible to achieve a tighter bend (e.g., higher radius of curvature) in individual wires than in a cable, which may provide more flexibility when selecting routing arrangements for the wire.

Another advantage that may be achieved by a cable connector assembly that is configured so as to permit one or more wires to exit a lateral surface of the backshell, for example, as illustrated in the embodiment of FIGS. 8–14, may include a reduction in force acting to disengage the cable connector assembly from its mating connection with the unit connector assembly. For example, in conventional cable connector assemblies wherein one or more wires (e.g., one or more cables) exit the back face of the backshell assembly in substantially the same direction as a direction of disengagement of the cable connector assembly from the unit connector assembly, the wire is typically bent outside the backshell assembly so as to fit the connector into a relatively small space for connection to a unit connector assembly. As a result, the weight of the one or more wires may create a force on the cable connector assembly that tends to disengage it from its mating engagement with the unit connector assembly. To counter this force, conventional connector assemblies are typically provided with a plurality of substantially symmetrically disposed screws that an operator manipulates to provide an additional clamping force acting to maintain the mating connection between the cable connector assembly and unit connector assembly.

In the exemplary embodiment of FIGS. 8–14, in which the cable connector assembly 800 is configured such that wire 845 exits a lateral surface 835*a* of the backshell 820, e.g., in a direction perpendicular to the direction the cable connector assembly 800 is moved to mate with the unit connector assembly 900, the exiting wire 845 need not be bent outside of the backshell 820. This may reduce the force tending to disengage the mating connection between the cable connector assembly 800 and the unit connector assembly 900. Therefore, additional fasteners, such as screws, for example, may not be needed to maintain the mated position between the cable connector assembly and the unit connector assembly.

To the extent, however, that an additional force may be needed to ensure the mated position between the cable connector and unit connector assemblies is maintained, it may be sufficient to provide a single, relatively easily manipulated fastener, or plural fasteners positioned on the same side of the electrical connectors. An example of such a fastener is illustrated in the cross-sectional view of FIG. 11. In the exemplary embodiment of FIG. 11, a fastener 860 is provided in conjunction with the backshell 820. The fastener 860 may be configured to extend through the backshell 820 and the housing 920 of the unit connector assembly 900 so as to provide a force that helps to maintain the mating connection of the cable connector assembly 800 to the unit connector assembly 900. The fastener 860 may be selected from various fasteners, including but not limited to, for example, a screw, a threaded bolt, a quick-connect fastener, and other similar fastening mechanisms. In an exemplary aspect, a quick connect ¼-turn fastener, such as, for example a "DZUS®" fastener may be used. One or more fasteners that require less manipulation may facilitate an operator in installing the cable connector assembly. Although only a single fastener 860 is depicted in the exemplary embodiment of FIGS. 8–14, it is envisioned that more than one fastener may be used to assist in securing the cable connector assembly 800 to the unit connector assembly 900. In an exemplary aspect, if more than one fastener is utilized, such fasteners need not be positioned symmetrically about the mating connectors 810 and 910. Instead, the fasteners may be positioned to one side of the connectors 810 and 910, which may, for example, facilitate access to the fasteners during manipulation.

As described above, the fastener 860 may comprise a handle 827 in order to facilitate manipulation of the fastener 860. In addition, provided that the strength of the fastener 860 is sufficient, the handle 827 may be used to grasp the backplate 825 during removal from/securement to the remaining portions of the backshell assembly 820 and/or to grasp the cable connector assembly 800 during removal from/engagement with the unit connector assembly 900

Figure 11:
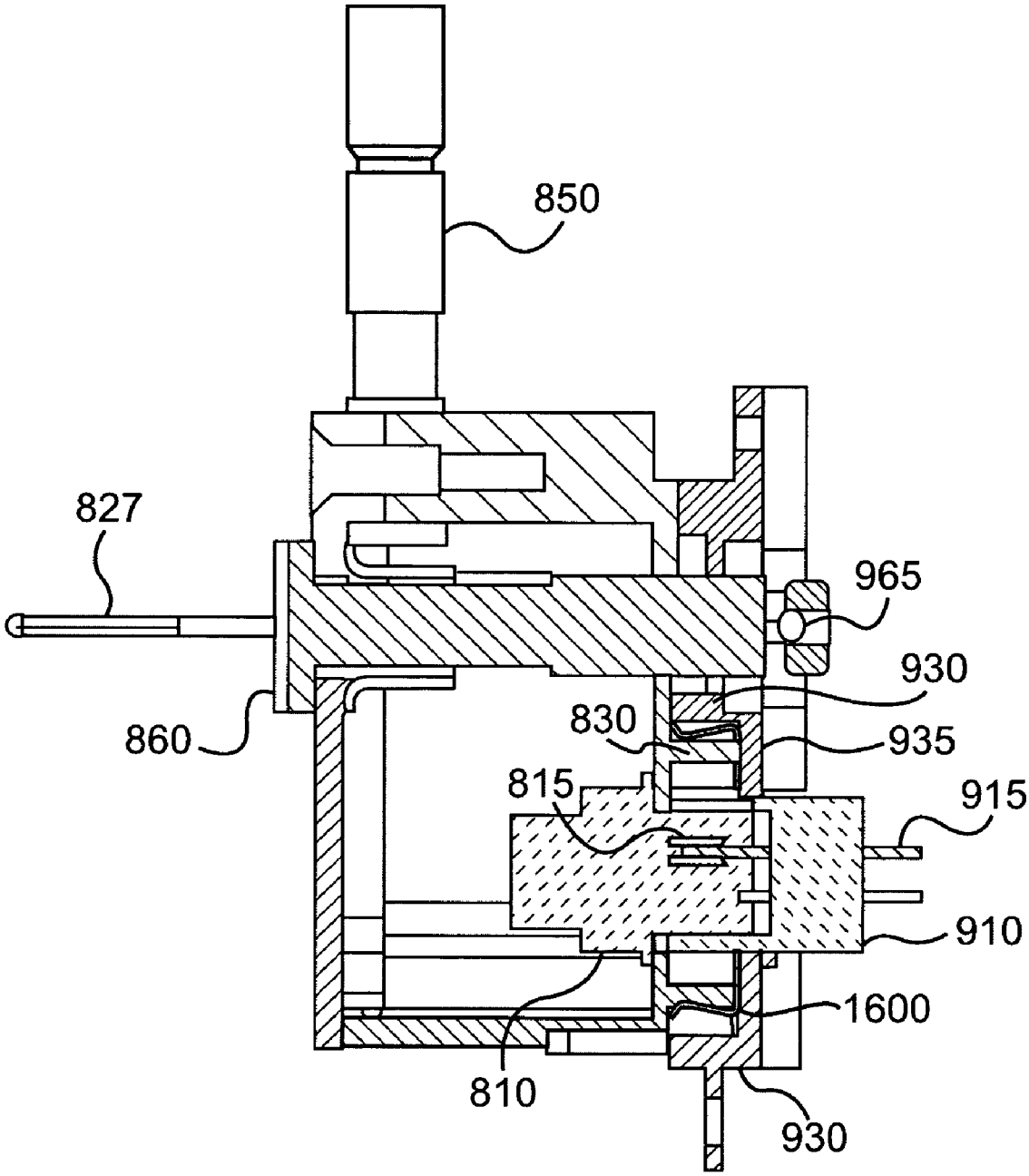
FIG. 11 is a cross-sectional view taken from line XI—XI of the electrical connector assembly of FIG. 9.

According to yet another exemplary aspect, as illustrated in FIGS. 11 and 12, for example, the backshell 820 may also include one or more lateral walls 830, which may be in the form of legs, for example, that are spaced from and surround the connector 810 and/or the fastener 860. The walls 830 may have free ends configured to contact the planar face of the unit housing 920, or if an electrical shield is being used, to contact the back face 1630 of an electrical shield 1600, as depicted in FIGS. 11 and 12, in a substantially perpendicular manner. By configuring the walls 830 to come into contact with the planar surface of the unit housing 920 or back face 1630 of the electrical shield 1600, a square connection between the cable connector assembly 800 to the unit connector assembly 900 can be facilitated.

Figure 13A:
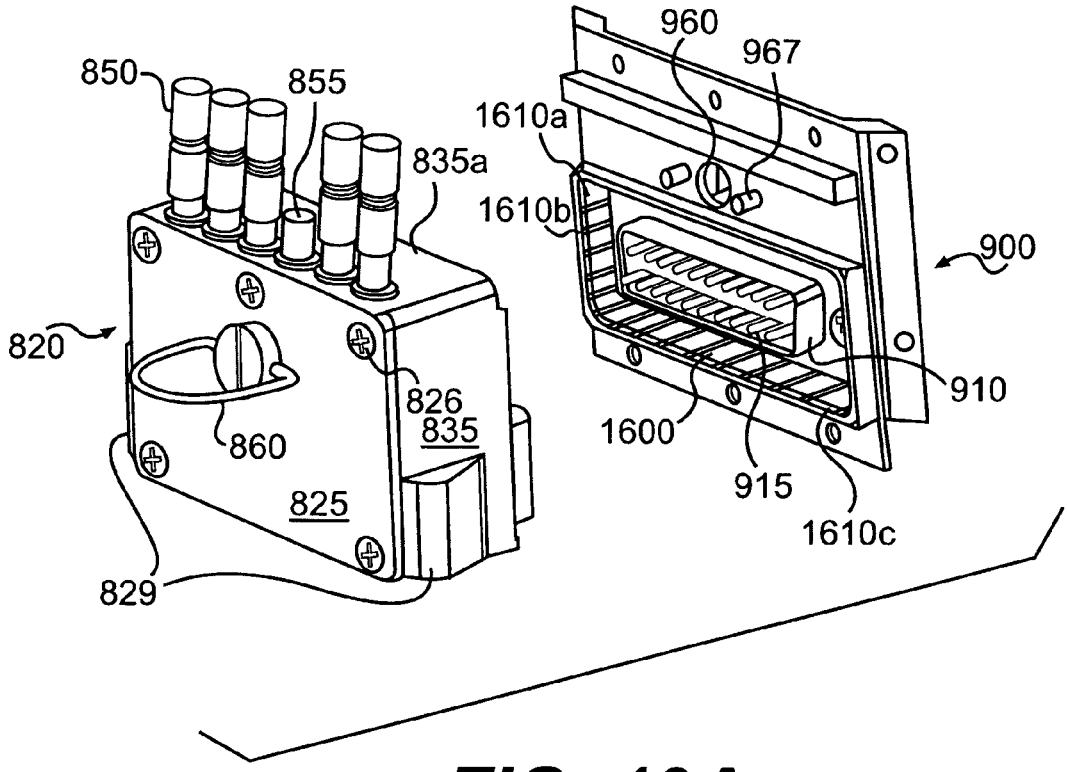
FIGS. 13A and 13B are perspective views of the cable connector assembly and unit connector assembly of FIG. 9 in an unmated position.
Figure 13B:
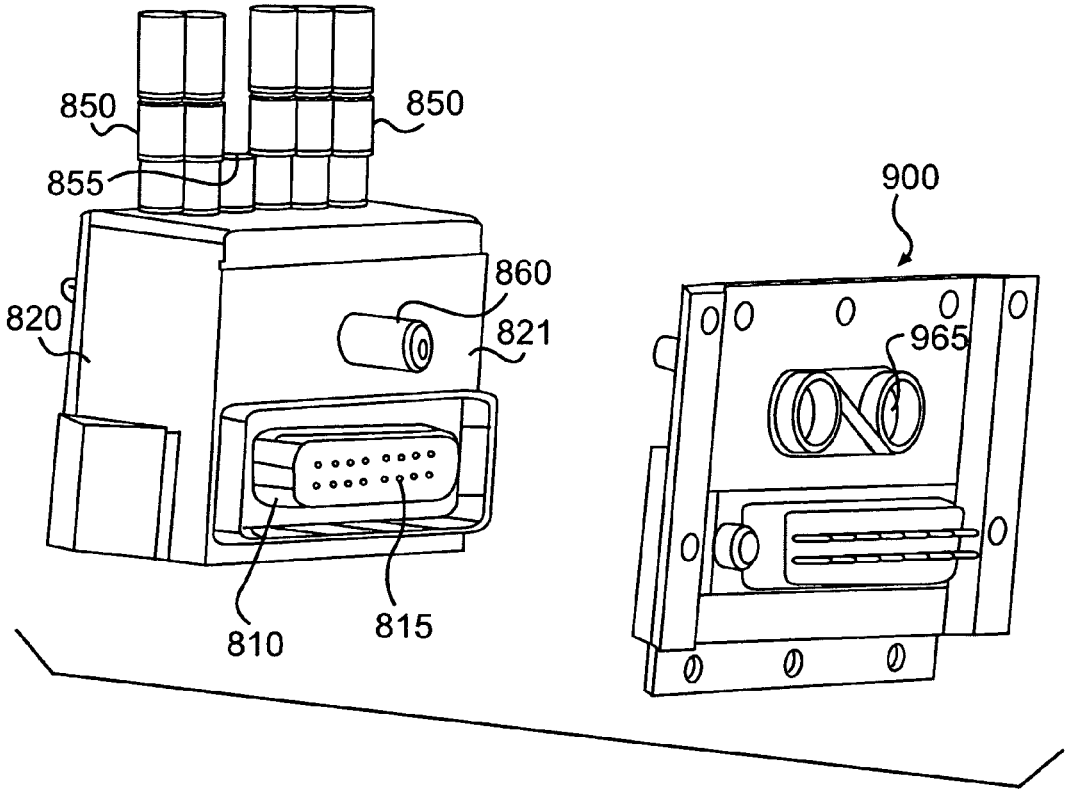
Figure 14:
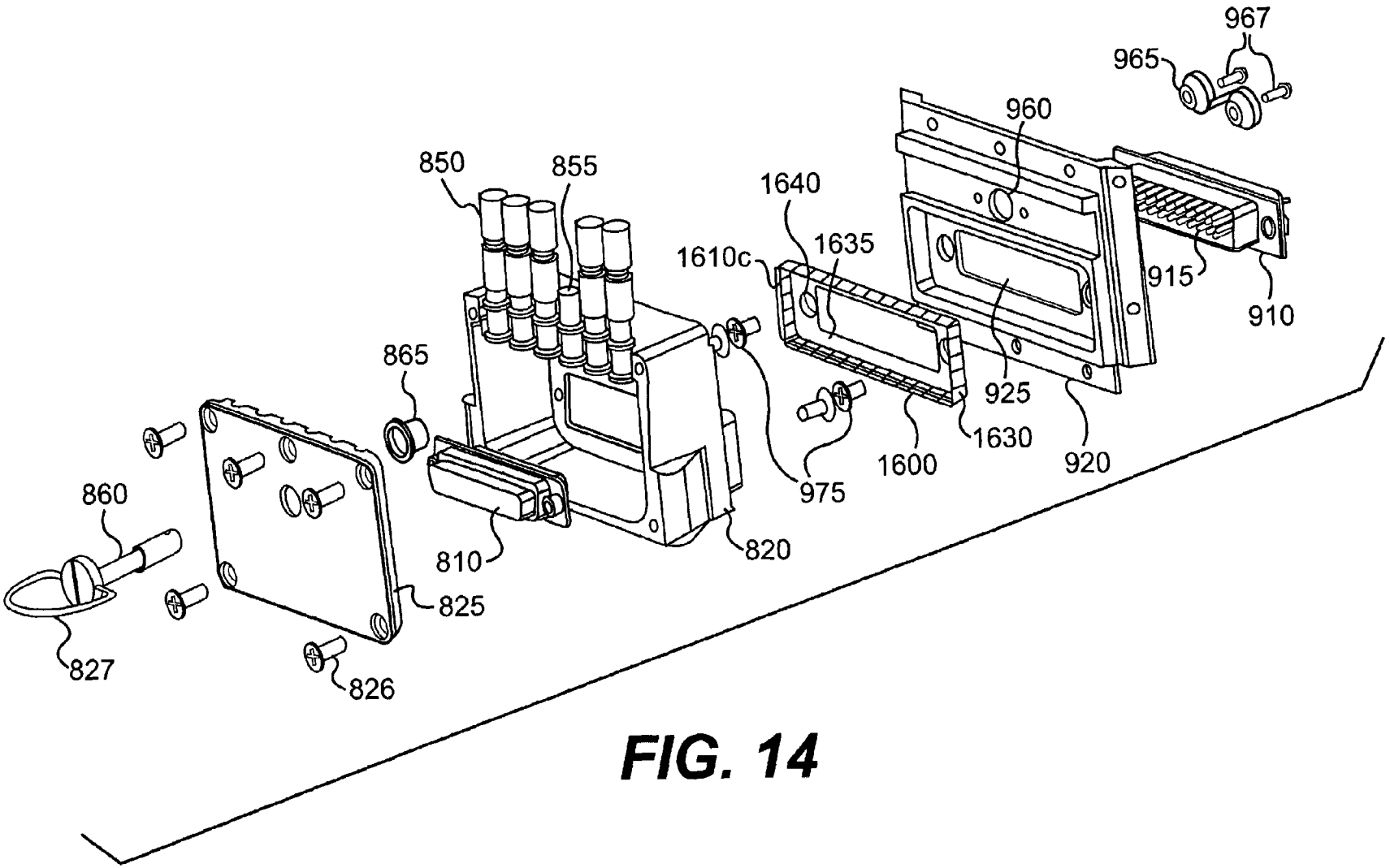
FIG. 14 is an isometric perspective view of the cable connector assembly and unit connector assembly of FIG. 9.

As discussed above, according to various exemplary aspects, an electrical connector assembly may include a cable connector assembly configured to permit wire to exit the backshell in a substantially perpendicular direction to the direction of engagement of the cable connector assembly and unit connector assembly and an electrical shield, such as, for example, an electrical shield configuration as described with reference to the exemplary embodiments of FIGS. 2–7. FIGS. 11–14 depict the electrical shield in conjunction with the electrical connector assembly of FIGS. 8–10. In particular, FIGS. 11 and 12 illustrate two differing cross-sectional views of the electrical connector assembly comprising a unit connector assembly 900 and a cable connector assembly 800, FIGS. 13A and 13B illustrate differing perspective views of the backshell assembly 820 and unit connector assembly of FIGS. 11 and 12, and FIG. 14 is an exploded isometric perspective view of the cable connector assembly 800 and unit connector assembly 900 (the wires are not shown in FIGS. 13 and 14.)

As illustrated in FIGS. 11–14, the electrical connector assembly 1000 includes a cable connector assembly 800 comprising a connector 810 holding and protecting electrical contacts 815 in the form of a plurality of female connector parts (e.g., receptacles) configured to receive a plurality of male electrical contacts 915 (e.g., pins, prongs, etc.) of the unit connector assembly 900. The connector 810 includes an opening at one end configured to receive one or more wires 845, which may form a cable, for example, that provide an electrical interface (not shown in the figures) with the electrical contacts 815. An opening at the opposite end of the connector 810 from where the wire is received is configured to receive the electrical contacts 915 and connector 910 of the unit connector assembly 900 when the unit connector assembly 900 and cable connector assembly 800 are in mated connection.

The cable connector assembly 800 also includes the backshell 820 configuration described with reference to FIGS. 8–10. The backshell 820 comprises a front face 821 that faces the unit connector assembly 900 during mating connection of the cable connector assembly 800 and the unit connector assembly 900.

As shown in FIG. 12, a wire 845 connected to the electrical connector 815 may form a bend within the interior of the backshell assembly 820, permitting the wire 845 to turn in a direction toward the respective opening 840 and tube 850 from which the wire 845 exits. The various advantages of bending the wire within an interior of the backshell and permitting the wire to exit from a lateral face of the backshell, as opposed to exiting from the back of the backshell, are discussed above with reference to the description of FIGS. 8–10.

In the exemplary embodiment of FIGS. 11–14, the unit connector assembly 900 comprises a housing 920 defining an opening 925 configured to receive an electrical connector 910. The electrical connector 910 may comprise, for example, a plurality of male contact parts 915, such as pins, prongs, or other male contact parts, for example, configured to be inserted into the plurality of receptacles 815 associated with the cable connector assembly 800. In an alternative arrangement not shown in FIGS. 11–14, the unit connector assembly could comprise an electrical connector in the form of one or more female connector parts and the cable connector assembly could comprise an electrical connector in the form of one or more male connector parts.

Surrounding the opening 925 and facing in a direction toward the cable connector assembly 800, an electrical shield 1600 according to exemplary aspects of the invention as discussed herein may be provided. In the exemplary embodiment shown in FIGS. 11–14, the shield 1600 may have a configuration similar to that described with reference to FIGS. 5–7. It should be understood, however, that any shield according to aspects of the invention could be employed, including, for example, a shield having a configuration similar to that described with reference to the exemplary embodiment of FIGS. 2–4 with appropriate modifications to other portions of the electrical connector assembly, as described with reference to the description of FIGS. 2–4 above. Moreover, it is envisioned that instead of attaching the electric shield to the housing 920 of the unit connector assembly, the electric shield may be provided on the backshell of the cable connector assembly 800, as discussed above with reference to the embodiments of FIGS. 2–7. If attaching the electric shield to the backshell of the cable connector assembly 800, appropriate modifications to the respective positions of the backshell lateral wall 830 and unit housing lateral wall 930 may be made so as to achieve the appropriate fit therebetween and between electrical shield and the lateral walls 830 and 930, so as to achieve the various arrangements of those elements described above with reference to the embodiments of FIGS. 2–7.

As with the exemplary embodiment of FIGS. 5–7, the shield 1600 may define a relatively large opening 1635 configured to receive the electrical connector 810 and two smaller countersunk openings 1640 configured to receive screws 975 and/or other securement mechanisms to secure the shield 1600 to a face of the housing 920 facing the electrical connector 810.

A plurality of biased fingers 1610, for example, spring-biased, may extend from a substantially planar base portion 1630 of the shield 1600. According to the exemplary embodiment of FIGS. 11–14, the fingers 1610 may be inwardly biased. FIGS. 13A and 13B illustrate perspective views of the unit connector assembly 900 in an assembled configuration viewing the unit connector assembly 900 from the side that faces the cable connector assembly 800 (FIG. 13A) and from the side that faces away from the cable connector assembly 800 (FIG. 13B), respectively, when the unit and cable connector assemblies are in mating connection.

As shown in FIGS. 11 and 12, when the cable connector assembly 800 is brought into a mated position with the unit connector assembly 900, a lateral wall 830 of the backshell 820 spaced from and surrounding the connector 810 pushes the inwardly-biased fingers 1610 of the shield 1600 outward as the male contact parts 915 are advanced into the female contact parts 815. Thus, as described above with reference to FIGS. 5–7, the cable connector assembly 800 and the unit connector assembly 900 are fully mated, the inward bias of the fingers 1610 is such that the fingers 1610 at bends 1610*c* are relatively tightly pressed against an outer surface of the lateral wall 830 so as to help maintain electrical contact between the backshell 820 and the unit connector housing 920.

For further details regarding exemplary configurations of the backshell, unit housing, electrical connectors, and shield, reference is made to the embodiments of FIGS. 2–10.

According to various exemplary aspects, the electrical connector assembly embodiment of FIGS. 11–14 may include a fastener 860. As illustrated in FIGS. 11, 13, and 14, the fastener 860 may extend through and attach to the backplate 825 such that at one end the fastener 860 may be grasped by the handle 827 and at the opposite end the fastener 860 is configured to extend into a hole 960 provided in the unit connector housing 920 for attachment thereto. As illustrated in FIGS. 13A, 13B, and 14, a retaining spring 965 may be attached to the unit housing 920, for example, via rivets 967, so as to receive the end of the fastener 860 that extends through the hole 960. The retaining spring 965 has a conventional configuration known to those skilled in the art for holding the quick connect fastener 860. Another retainer 865 may be provided on the opposite side of the backplate 825 from the handle 827 and may be mechanically crimped to the fastener 860, for example, at the region of reduced cross-section of the fastener, so as to hold the fastener 860 into the backplate 825. The fastener 860 may be disposed so as to be offset to one side of the interface connection of the cable electrical connector 810 and the unit electrical connector 910, as illustrated in FIGS. 11 and 13–14.

As discussed, due to the routing of wire from a lateral face 835 rather than the back of the backshell assembly 820, as well as the configuration of the shield 1600, a single, relatively easily manipulated fastener configured and positioned as described with reference to the fastener 860 of FIGS. 8–14 may be utilized to assist in maintaining the mating connection between the cable connector assembly 800 and the unit connector assembly 900, and to assist in maintaining the electrical contact between the unit housing 920 and backshell 820. In other words, routing the wires 845 so as to form a bend within the interior of the backshell 820 and so as to exit from the backshell 820 in a direction substantially perpendicular to the plane of the interface connection between the cable connector assembly 800 and unit connector assembly 900 (e.g., perpendicular to the direction of movement of the cable connector assembly 800 during mating with the unit connector assembly 900) tends to minimize forces associated with the weight and cable bending forces of the exiting wires that tend to disengage the cable connector assembly from the unit connector assembly in conventional electrical connector assemblies having wires exiting the back of the backshell assembly. Moreover, the configuration of the electrical shield 1600 and the engagement between the shield 1600 and the lateral wall 830 also may provide a stronger connection force between the cable connector assembly and unit connector assembly. However, it should be understood that a backshell configured to permit wire to exit via the backshell in a direction substantially perpendicular to the direction of movement of the backshell during mating of a cable connector assembly to a unit connector assembly need not be utilized in conjunction with a unit connector assembly comprising an electric shield as disclosed herein. For example, the cable connector assembly 10 illustrated in FIG. 1 need not be part of an electrical connector assembly comprising an electrical shield, as illustrated in FIG. 14, for example, although in some exemplary embodiments it may be.

Thus, in lieu of a plurality of relatively strong clamping mechanisms, such as, for example, screws, symmetrically positioned relative to the cable connector and unit connector, one or more fasteners that are relatively easy to manipulate, such as, for example, a DZUS® fastener or other quick-connect fastener), and disposed in an offset manner may be utilized. To hold the connectors 810 and 910 together with a substantially uniformly distributed force, however, the fastener may be positioned approximately at a centerline of the backshell, as depicted in FIGS. 13A, 13B, and 14. In an alternative, more than one fastener may be positioned substantially symmetrically relative to the centerline, but on the same side of the connectors, which arrangement also may facilitate a user in accessing and manipulating the fasteners. Such fastener configurations may facilitate an operator in installing and/or removing the cable connector assembly. It should be understood that a variety of fastening mechanisms other than that depicted and described in the exemplary embodiment of FIGS. 8–14 may be utilized, such as, for example, a screw, a bolt, or other fastening mechanisms.

Although in the various embodiments described herein, an electrical shield was shown in conjunction with the various electrical connector assemblies, it is envisioned that such a shield may not be needed, such as, for example, in cases of reduced EMI/RFI levels of exposure and/or in cases where EMI/RFI shielding requirements are not as stringent. For example, in FIGS. 8–14, it is envisioned that the backshell configuration permitting wires to exit a right angle may be utilized in an electrical connector assembly that does not comprise an electric shield like shields 300, 600, or 1600 described herein. Further, it is envisioned that the backshell 220, 520, 820 may be configured such that the free end of the backshell lateral wall 230, 530, 830 may be in contact with the back wall 135, 435, 935 when the cable connector assembly 200, 500, 800 is in a mated position with the unit connector assembly 100, 400, 900. For example, as shown by E labeled in FIG. 3, the contact between the lateral wall 230 and back wall 135 may be sufficient according to some exemplary aspects to provide the electrical connectivity between the backshell 220 and housing 120 and therefore, the electrical shield 300 may not be needed. Similarly, in the embodiments of FIGS. 6 and 11, it is envisioned that the shield 600, 1600 may be removed and the free ends of the lateral wall 530, 830, may directly contact the back wall 435, 935 so as to provide the electrical connectivity between the backshell 520, 820 and the housing 420, 920.

It should be understood that sizes, configurations, numbers, and positioning of various structural parts and materials used to make the above-mentioned parts are illustrative and exemplary only. One of ordinary skill in the art would recognize that those sizes, configurations, numbers, positioning, materials, and/or other parameters can be changed to produce different effects, desired characteristics, and/or to achieve different applications than those exemplified herein. It is envisioned that the various components of the electrical connector assemblies described herein may be made by sheet metal techniques, machining, casting, heat treating, or other known fabrication techniques. Further, by way of example, it is envisioned that any number of wires may be utilized with the cable connector assembly and may or may not form any number of cables. The term cable connector assembly should not be understood to be limited to a connector assembly that houses a plurality of wires forming a cable, but rather is intended to also more broadly cover an embodiment wherein individual wires (including a single wire) is provided for electrical interface with an electrical connector.

It also should be understood that various electrical connectors may be utilized in conjunction with the cable connector assembly and unit connector assemblies and the embodiments illustrated herein are exemplary only. Thus, it is envisioned, for example, that the electric shields according to aspects of the invention could be used with any type of connector by reconfiguring the shield and the mating housings (e.g., backshell and unit housing) to fit appropriately around the mating connectors. Further, in various exemplary embodiments, it is envisioned that the electric shields according to aspects of the invention may be provide in conjunction with the cable connector assembly and configured to be in biased engagement with a portion of the housing of the unit connector assembly.

Moreover, although the electrical connector assemblies described herein are contemplated for use in aeronautical settings, it is envisioned that the electrical connector assemblies could be used in a variety of applications, including any application in which it is desirable to connect a cable to an electronic unit to provide an electrical signal, including power, data and/or other signals between the two.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations. Other embodiments of the invention will be apparent to those skilled in the art from consideration of the specification and practice of the invention disclosed herein.

What is claimed is:

1. An electrical connector assembly, comprising:

a first backshell housing including a first electrical connector disposed therein;

a second backshell housing including a second electrical connector disposed therein;

a quarter-turn fastener releasibly coupling the first backshell housing to the second backshell housing such that the first electrical connector is mated with the first electrical connector so as to provide an electrical signal pathway therebetween; and a one-piece shield disposed between, and providing electrical and mechanical connectivity between, the first backshell housing and the second backshell housing, the one-piece shield comprising a plurality of biased members that surround at least a portion of the first electrical connector and at least a portion of the second electrical connector, the one-piece shield having a base portion and a longitudinal axis defining a center of the one-piece shield, the plurality of biased members each including an upper portion coupled to a lower portion at a first angle in the range of about 95 degrees to about 135 degrees and biased outwardly away from the longitudinal axis, wherein the lower portion is coupled to the base portion at a second angle in the range of about 100 degrees to about 130 degrees.

2. The electrical connector assembly of claim 1, wherein the members are spring-biased.

3. The electrical connector assembly of claim 1, wherein the second electrical connector is configured to be in electrical connectivity with an electronic unit.

4. The electrical connector assembly of claim 1, wherein the second electrical connector is configured to be in electrical connectivity with at least one wire.

5. The electrical connector assembly of claim 4, wherein the second backshell housing comprises at least one opening configured to receive the at least one wire such that the at least one wire exits the second backshell housing in a direction substantially perpendicular to the direction of movement of the second backshell housing.

6. The electrical connector assembly of claim 5, wherein the second backshell housing comprises a front face, a back face, and a plurality of lateral faces, and the at least one opening is defined by at least one of the lateral faces.

7. The electrical connector assembly of claim 1, wherein the members are biased such that at least a portion of each member is pressed against a portion of the second backshell housing.

8. The electrical connector assembly of claim 1, wherein the members are configured to engage a lateral wall of the second backshell housing that surrounds the second electrical connector.

9. The electrical connector assembly of claim 8, wherein inner surface portions of the members are configured to engage outer surface portions of the lateral wall.

10. The electrical connector assembly of claim 8, wherein outer surface portions of the members are configured to engage inner surface portions of the lateral wall.

11. The electrical connector assembly of claim 10, wherein an edge of the lateral wall is beveled.

12. The electrical connector assembly of claim 11, wherein an edge defined by an outer surface of the lateral wall is beveled.

13. The electrical connector assembly of claim 11, wherein an edge defined by an inner surface of the lateral wall is beveled.

14. An electrical connector assembly, comprising:

a first backshell housing including a first electrical connector disposed therein;

a second backshell housing including a second electrical connector disposed therein;

a quarter-turn fastener releasibly coupling the first backshell housing to the second backshell housing such that the first electrical connector is mated with the first electrical connector so as to provide an electrical signal pathway therebetween; and a one-piece shield disposed between, and providing electrical and mechanical connectivity between, the first backshell housing and the second backshell housing, the one-piece shield comprising a plurality of biased members that surround at least a portion of the first electrical connector and at least a portion of the second electrical connector, the one-piece shield having a base portion and a longitudinal axis defining a center of the one-piece shield, the plurality of biased members each including an upper portion coupled to a lower portion at a first angle in the range of about 95 degrees to about 135 degrees and biased inwardly toward the longitudinal axis, wherein the lower portion is coupled to the base portion at a second angle in the range of about 50 degrees to about 80 degrees.

* * * * *